US006273967B1

(12) United States Patent
Matsuki et al.

(10) Patent No.: US 6,273,967 B1
(45) Date of Patent: Aug. 14, 2001

(54) LOW BORON AMORPHOUS ALLOY AND PROCESS FOR PRODUCING SAME

(75) Inventors: Kensuke Matsuki; Fumio Kogiku; Nobuo Shiga; Masao Yukumoto, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 08/791,753

(22) Filed: Jan. 29, 1997

(30) Foreign Application Priority Data

Jan. 31, 1996 (JP) ..... 8-015346

(51) Int. Cl.[7] ..... H01F 1/153
(52) U.S. Cl. ..... 148/304; 148/403; 420/121
(58) Field of Search ..... 148/304, 403; 420/117, 121

(56) References Cited

U.S. PATENT DOCUMENTS 5,466,304 11/1995 Kogiku et al. .

FOREIGN PATENT DOCUMENTS 0 060 660 A1 9/1982 (EP) .
0 640 419 A1 3/1995 (EP) .
61-136660 6/1986 (JP) .
62-192560 8/1987 (JP) .
5-222493 8/1993 (JP) .
7-331396 12/1995 (JP) .

OTHER PUBLICATIONS

*IEEE Transactions on Magnetics*, Sep. 1985 vol. Mag–21, No. 5, pp. 2029–2031, 1985 International Magnetics Conference, St. Paul, MN, Apr. 29–May 2, 1985.

*Primary Examiner*—John Sheehan
(74) *Attorney, Agent, or Firm*—Austin R. Miller

(57) ABSTRACT

An amorphous alloy having a boron content of about 6 to 10 at %, cast into a plate, wherein the plate thickness is about 15 to 25 μm, and the surface roughness $Ra_{0.8}$ of the plate is about 0.8 μm or less.

5 Claims, 9 Drawing Sheets

LOW BORON AMORPHOUS ALLOY AND PROCESS FOR PRODUCING SAME

BACKGROUND OF THE INVENTION

1. Field of the Invention

The present invention relates to a low boron amorphous alloy and a process for producing the same, specifically to a low boron-containing Fe—Si—B base amorphous alloy which achieves improved magnetic properties together with scattering reduction. The term "low boron" is here intended to define an Fe—Si—B alloy containing about 6–10 atomic percentage of boron.

2. Description of the Related Art

Various Fe—B—Si base alloy compositions have excellent soft magnetic properties. An amorphous alloy composition comprising 80 to 84 atomic percent (at %) of iron, 12 to 15 at % of boron and about 6 at % of silicon is disclosed in U.S. Pat. No. 4,300,950 of Chen, Luborsky et al. Further, an alloy comprising 77 to 80 at % of iron, 12 to 16 at % of boron and 5 to 10 at % of silicon is disclosed in U.S. Pat. No. 5,370,749.

Thus, almost all Fe—Si—B base amorphous alloys which have so far been known have a content of boron of more than 10 at %.

This is because boron is important to prevent crystallization of the alloy. The higher the boron content, the stronger the amorphous formability of the alloy, and the better the alloy thermal stability.

Magnetic properties of those Fe—Si—B base amorphous alloys having a boron content of 10 at % or less have been inferior in core loss and flux density, as compared with those having a boron content of more than 10 at %.

Accordingly, reports on Fe—Si—B base amorphous alloys having a boron content of more than 10 at % are very scarce. Reported more often are alloys containing carbon as a material for improving stability toward change on standing, and resistance to crystallization in Japanese Unexamined Patent Publication No. 57-145964 and Japanese Unexamined Patent Publication No. 58-42751. Also reported are alloys containing Mn as a material for improving surface-treating properties (Japanese Unexamined Patent Publication No. 61-136660) and alloys containing Cr as a material for improving castability (Japanese Unexamined Patent Publication No. 58-210154).

In addition thereto, the characteristics of low boron alloys are lacking for reasons already described above.

It is described in Japanese Unexamined Patent Publication No. 4-333547 that a reduction of core loss in a high frequency range of electrical steel is a requisite for improvement of a core loss by controlling plate thickness. However, the high frequency range used in that publication is a very high frequency range such as 100 kHz, 200 KHz, 500 KHz or 1 MHz. It is known that a large part of a core loss consists of an eddy current loss in such a high frequency range, and it is also known that eddy current loss can be reduced by decreasing plate thickness.

In contrast with this, it is known that in a commercial frequency area as applied to the present invention, some optimum value of plate thickness is present for minimizing core loss in the case of an Fe—Si—B base amorphous alloy. Reduction of the plate thickness to the optimum value or less rather increases the total core loss because of increased hysteresis loss.

Further, it is reported in Japanese Unexamined Patent Publication No. 62-192560 that the space factor is elevated by controlling ribbon roughness. Core loss and flux density are affected by reduction of ribbon roughness, which facilitates transfer of magnetic domain walls and therefore decreases hysteresis loss but increases eddy current loss since coarsening of the magnetic domain takes place.

SUMMARY OF THE INVENTION

There remain the problems that magnetic properties of Fe—Si—B base amorphous alloys having a boron content of 10 at % or less are inferior in both core loss and flux density as compared with those of alloy compositions having a boron content of more than 10 at %, and that they demonstrate notable scattering.

Boron is a relatively expensive element. Therefore, low boron alloys whose properties can stand comparison with amorphous alloys having a high boron content would be of great economical advantage.

The present invention has an object to provide a low boron alloy which can provide excellent magnetic properties standing comparison with alloys having a boron content of more than 10 at %. Another object is to provide an alloy having a boron content of 10 at % or less and which has less scattered magnetic properties. Still another object is to optimize plate thickness and surface roughness of the amorphous alloy, to provide a less expensive but competitive product. Another object is to provide an advantageous process for producing the novel alloy.

DETAILED DESCRIPTION OF THE INVENTION

Figure 1:
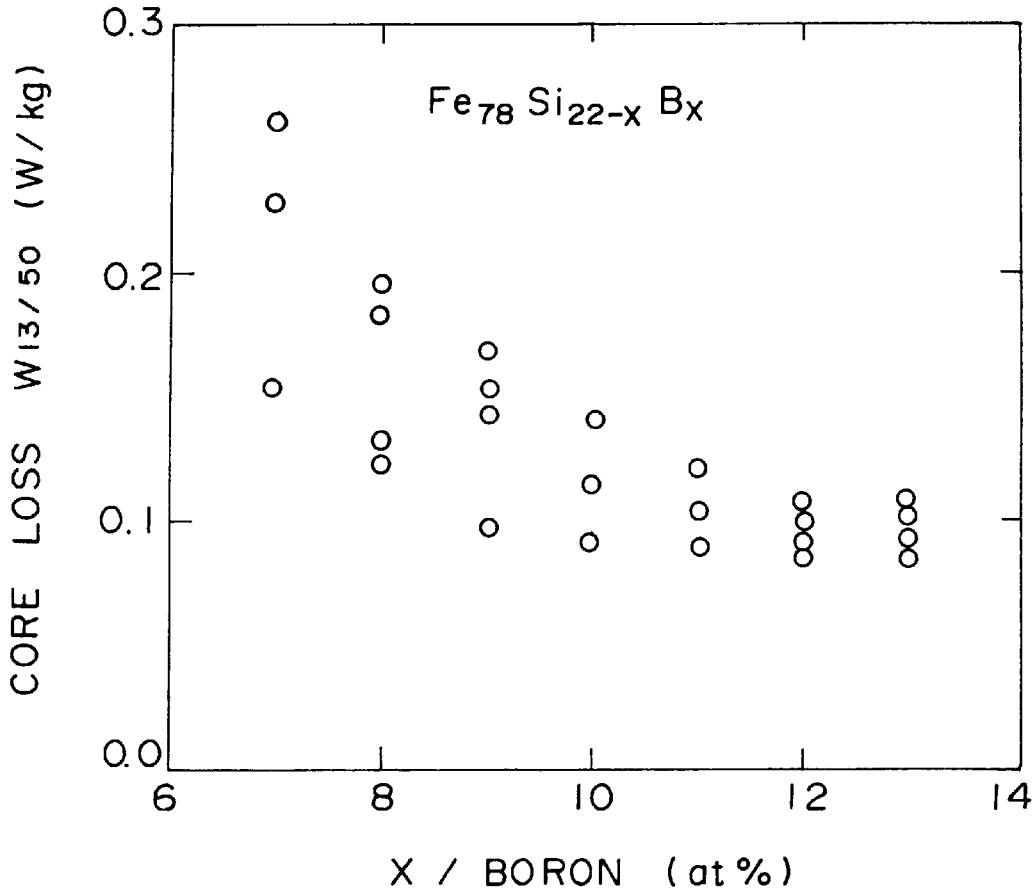
FIG. 1 is a graph showing relationship between core loss and boron content of a plurality of amorphous alloys having compositions of $Fe_{78}Si_{22-x}B_x$, where x ranges from 7 to 13.

The present invention effectively creates a novel and advantageous low boron amorphous alloy and a continuously cast alloy ribbon made by casting the molten metal on a rotating drum, such alloy ribbon having excellent magnetic properties. It has a boron content of about 6 to 10 at %, and can be formed into a plate having a plate thickness of about 15 to 25 μm, and a surface roughness $Ra_{0.8}$ of about 0.8 μm or less, where $Ra_{0.8}$ means the center line average roughness on the contact face with a quenching roll, which roughness is determined at a cut-off value of 0.8 mm.

The preferable boron content is about 6 to 8 at %; the preferable plate thickness is about 15 to 20 μm; and the preferred surface roughness $Ra_{0.8}$ is about 0.6 μm.

Preferably, the ejection pressure of the molten metal through the casting ejection nozzle is controlled to about 0.3 to 0.6 kg/cm$^2$, and the casting roll peripheral speed is preferably about 35 to 50 m/sec when producing the ribbon or plate by single-roll quick cooling solidification.

Preferably, the low boron amorphous alloy of this invention is a low boron-containing Fe—Si—B base amorphous alloy having a boron content of about 6 to 10 at %, formed as a plate or ribbon having a thickness of about 15 to 25 μm, and its surface roughness $Ra_{0.25}$ (center line average roughness on quenching roll contact face, which roughness is determined at a cut-off value of 0.25 mm), is about 0.3 μm or less.

Preferably, the boron content of the alloy and of the plate or ribbon is about 6 to 8 at %; the plate or ribbon thickness is about 15 to 20 μm; and its surface roughness $Ra_{0.25}$ is about 0.2 μm or less. Preferably, the ejection pressure of the molten metal is about 0.3 to 0.6 kg/cm$^2$, and the roll peripheral speed is about 35 to 50 m/sec in single-roll quick cooling solidification.

Preferably, the process is controlled at an ejection pressure of the molten metal at about 0.3 to 0.6 kg/cm$^2$, and the roll peripheral speed is about 35 to 50 m/sec in quickly cooling and solidifying at a boron content of about 6 to 10 at % using the single-roll method, to produce a low boron amorphous alloy having a plate thickness of about 15 to 25 μm.

The $CO_2$ concentration in the environment surrounding the cooling and solidifying procedure is preferably controlled at about 50 vol % or more. The slit thickness of the nozzle used for ejecting the molten metal alloy against the rotating roll is about 0.6 to 1.0 mm. The slit thickness of the nozzle for ejecting the molten metal is preferably about 0.6 to 1.0 mm, and the gap between the nozzle and the roll is preferably about 0.1 to 0.2 mm.

It has now been discovered that an amorphous alloy containing about 6–10 at % boron shows a roughness dependency which is completely opposite to that of a conventional high boron amorphous alloy. The art has so far considered that in a high boron amorphous alloy, a substantial amount of surface roughness rather coarsens the magnetic domain and thereby increases the core loss, and that a rather coarse surface roughness is better than a smoother one, to a certain extent.

In contrast with this, the more the surface roughness of a low boron amorphous alloy is reduced, the more the core loss is reduced, and the dependency of core loss upon surface roughness is very much increased.

It has surprisingly been discovered that magnetic properties of the alloy can be radically improved in a low boron-containing Fe—Si—B base amorphous alloy by producing the amorphous alloy in a form having low surface roughness.

Surface roughness is generally evaluated by those skilled in the art as a center line average roughness when a cut-off value of 0.8 mm is employed. It is hereinafter expressed as $Ra_{0.8}$.

It is known with respect to many iron based alloys that since reduction of surface roughness facilitates a transfer of magnetic domain walls, the hysteresis loss out of the core loss is reduced. It is known as well, however, that in the case of a $Fe_{78}Si_9B_{13}$ alloy which is a typical example of a conventional boron-containing Fe—Si—B base amorphous alloy, the more the surface roughness is decreased, the more the core loss is instead increased in a range where the surface roughness $Ra_{0.8}$ on its contact face with a quenching roll is 1.0 μm or less. It is conventionally believed that such action is due to the fact that an decrease of surface roughness coarsens the magnetic domains to increase the eddy current loss over a decrease of hysteresis loss.

Accordingly, surface roughness of the alloy has not so far had to be decreased less than needed. In addition, dependency of core loss on roughness is conventionally not so great as to suggest control of surface roughness.

In contrast with this, it has been discovered that in the low boron Fe—Si—B base amorphous alloy of the present invention, the more the surface roughness of the alloy is decreased, the more the core loss is also decreased (FIG. 5), and the more the dependency of core loss upon surface roughness is increased.

Further, it has been found that dependency of core loss on plate thickness is important. The core loss is reduced according to the decrease of plate thickness with either high or low boron alloys, but the dependency is larger in the case of low boron alloys.

Accordingly, particularly in a low boron amorphous alloy, the plate thickness and the surface roughness have a large influence on the magnetic properties of the alloy. Therefore a core loss capable of standing comparison with that of a high boron amorphous alloy can now be obtained by controlling the plate thickness and the surface roughness of a low boron alloy in a suitable range.

Test results have factually confirmed the foregoing, as is illustrated in the appended drawings.

Investigation of the relationship between core loss and boron content of various amorphous alloys having compositions of $Fe_{78}Si_{22-x}B_x$ is shown in FIG. 1. Using surface roughnesses and plate thicknesses outside of this invention, it is generally observed that if the boron content is 10 at % or less, the core loss increases as compared with that of a boron content above 10 at %, and scattering is increased as well.

We have discovered that plate thickness and surface roughness are critical factors exerting an unexpectedly strong influence on core loss, and that a relation shown by the following equation exists between the core loss W ($W_{13/50}$), the plate thickness t and the surface roughness $Ra_{0.8}$:

$$W=a+b\cdot t+c\cdot Ra_{0.8} \quad (1)$$

wherein a, b and c are factors determined according to the compositions of Fe, Si, B, C, P and Mn and satisfy the following ranges:

$$0<a<0.02,\ 0.001<b<0.004,\ 0.05<c<0.2$$

What is worth special mention in the equation (1) described above is that the factor c for the surface roughness of the amorphous alloy having a boron content of more than 10 at % varies in a direction completely opposite to that of an amorphous alloy having a boron content of 10 at % or less.

Reduction in surface roughness $Ra_{0.8}$ to 0.8 μm or less in a conventional amorphous alloy having a boron content exceeding 10 at % suddenly increased the factor c and substantially increased the core loss.

As reported in Japanese Unexamined Patent Publication No. 62-192560, while a decrease in surface roughness of a ribbon tends to facilitate transfer of magnetic domain walls to reduce hysteresis loss, it coarsens magnetic domains at the same time and therefore instead increases the eddy current loss, which leads accordingly to an increase of total core loss.

In contrast with this, even if the surface roughness $Ra_{0.8}$ is reduced to 0.8 μm or less in a low boron amorphous alloy having a boron content of 10 at % or less, the factor c is fixed in every component system and is not increased.

Figure 2:
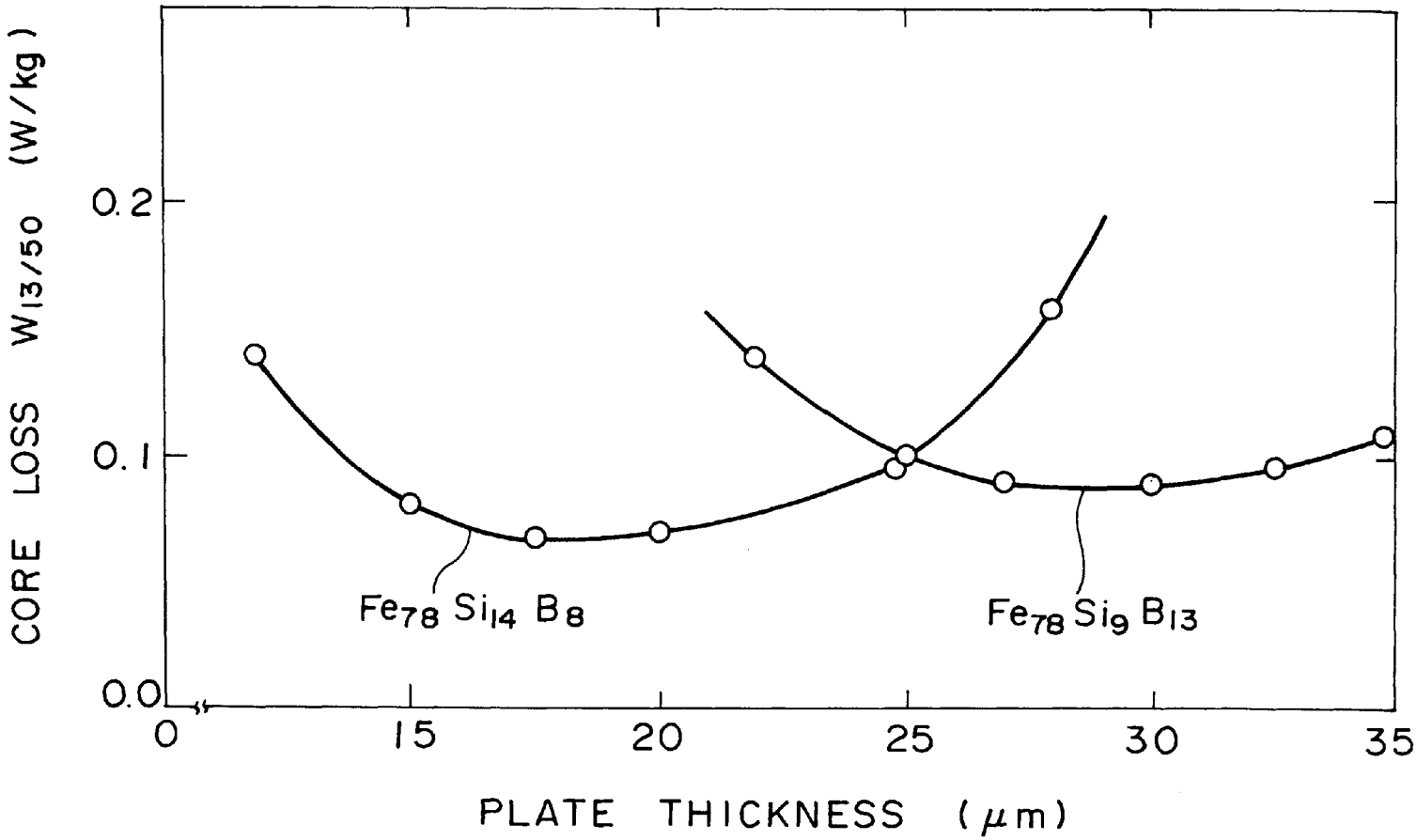
FIG. 2 is a graph showing two examples of core losses plotted against plate thicknesses of amorphous alloys having the compositions $Fe_{78}Si_{14}B_8$ (within the invention) and $Fe_{78}Si_9B_{13}$ (outside of the invention).

Accordingly, in the amorphous alloy of this invention having a boron content of 10 at % or less, the core loss would normally be expected to be increased by reducing the surface roughness $Ra_{0.8}$ down to a region of 0.8 μm or less, because this has been considered to be disadvantageous in terms of core loss. However, we have investigated carefully the influences of plate thickness and surface roughness $Ra_{0.8}$ exerted on core loss, and scattering thereof, particularly in amorphous alloys having a boron content of 10 at % or less. Remarkable and opposite results obtained on alloys having the compositions $Fe_{78}Si_{14}B_8$ (within the invention) and $Fe_{78}Si_9B_{13}$ (outside of the invention) are shown in FIG. 2.

The $Fe_{78}Si_{14}B_8$ amorphous alloy of this invention showed a particularly good core loss value in a range of about 15 to 25 μm, which is somewhat thinner than that of the $Fe_{78}Si_9B_{13}$ amorphous alloy.

The underlying reasons are not fully apparent, but may considered due to the fact that a plate thickness exceeding 25μm causes the surface to locally crystallize, and that a plate thickness of less than 15 μm generates stripes due to gas caught up into a puddle and causing partial clogging of the nozzle during plate casting to deteriorate the surface properties of the plate.

Accordingly, in the present invention, the plate thickness of the amorphous alloy is limited to a range of about 15 to 25 μm, more preferably about 15 to 20 μm.

Next, the influence of surface roughness $Ra_{0.8}$ exerted on the core loss of the alloy has been investigated.

Samples having a fixed plate thickness of 20 μm and variously different surface roughnesses $Ra_{0.8}$ have been prepared from molten metals of the alloys having the compositions of $Fe_{78}Si_{14}B_8$ and $Fe_{78}Si_{15}B_7$ by variously changing and combining the molten metal nozzle ejection pressure with the roll peripheral speed that is used for casting.

Figure 3:
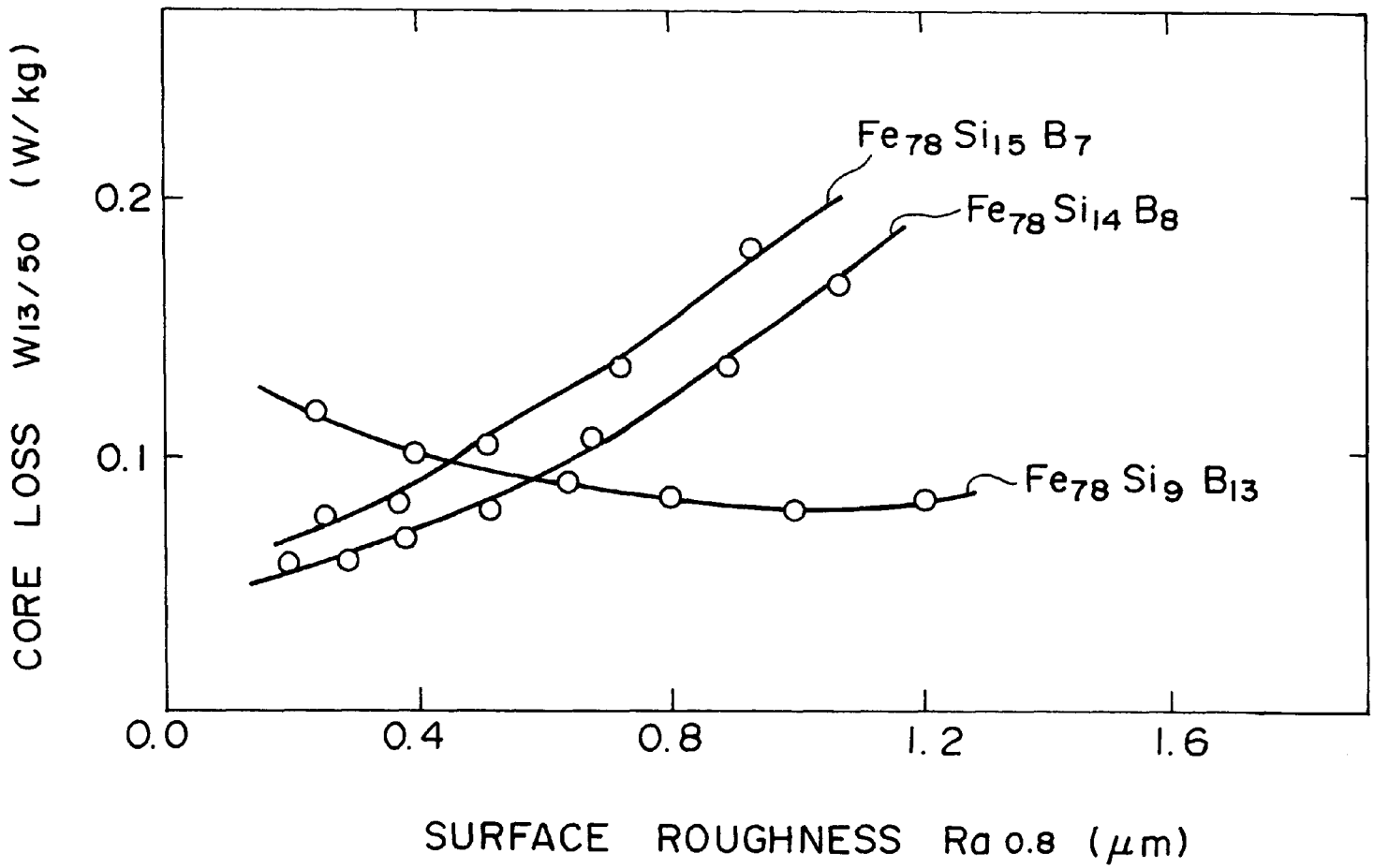
FIG. 3 is a graph showing core losses and surface roughnesses $Ra_{0.8}$ of three amorphous alloys having the compositions $Fe_{78}Si_{14}B_8$ and $Fe_{78}Si_{15}B_7$ (within the invention) and $Fe_{78}Si_9B_{13}$ (outside of the invention).

Results obtained by investigating the relationship between surface roughnesses $Ra_{0.8}$ and core loss properties in respective samples are shown in FIG. 3. Further, the results obtained using a composition $Fe_{78}Si_9B_{13}$ is also shown in FIG. 3 for the sake of comparison.

As is apparent from FIG. 3, the lower the surface roughness $Ra_{0.8}$ of the low boron ($B_7$ and $B_8$) amorphous alloys, the more the core loss $W_{13/50}$ was decreased (improved).

In contrast with this, the conventional high boron ($B_{13}$) amorphous alloy of FIG. 3 had a minimum core loss W at the surface roughness $Ra_{0.8}$ of about 1.0 μm, and had a significantly higher core loss at all lower values of surface roughness $Ra_{0.8}$.

Accordingly, in the present invention, the surface roughness of the amorphous alloy is limited to a range of about 0.8 μm or less in terms of $Ra_{0.8}$. The range is preferably about 0.6 μm or less, more preferably about 0.4 μm or less.

Why a surface roughness $Ra_{0.8}$ exceeding 0.8 μm cannot provide a good core loss is not fully defined. However, it is believed that in the casting process a coarsened alloy surface tends to increase gas pocket generation at the ribbon thus reducing the cooling rate in producing the cast plate. It is believed that this may cause a crystalline nucleus to be formed locally on the alloy surface to disturb the magnetic domains on the surface.

The relationship between the core losses and the surface roughness cut-off values has been investigated. As a result, different correlations have been obtained, depending on the surface roughness cut-off value that is used in determining the surface roughness.

Figure 4:
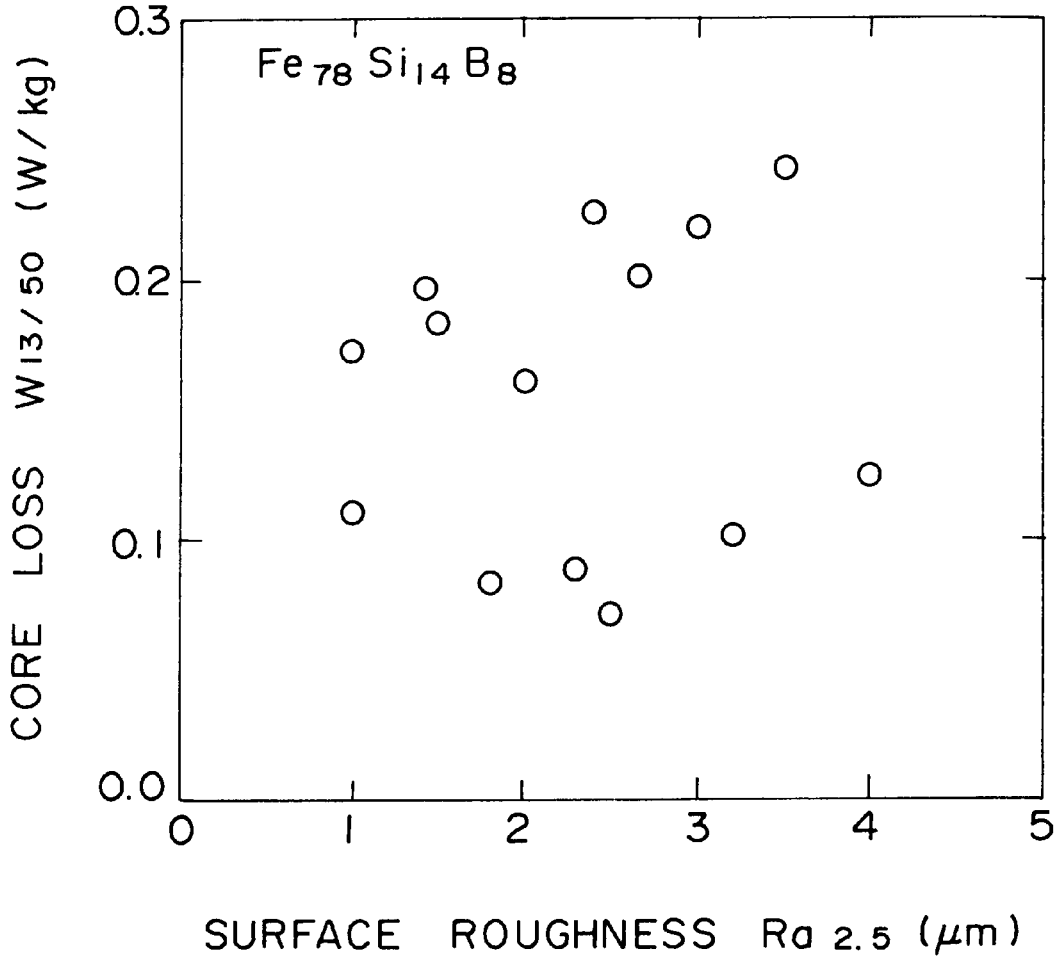
FIG. 4 is a graph showing the relationship between core loss and surface roughness $Ra_{2.5}$ of an amorphous alloy having the formula $Fe_{78}Si_{14}B_8$.
Figure 5:
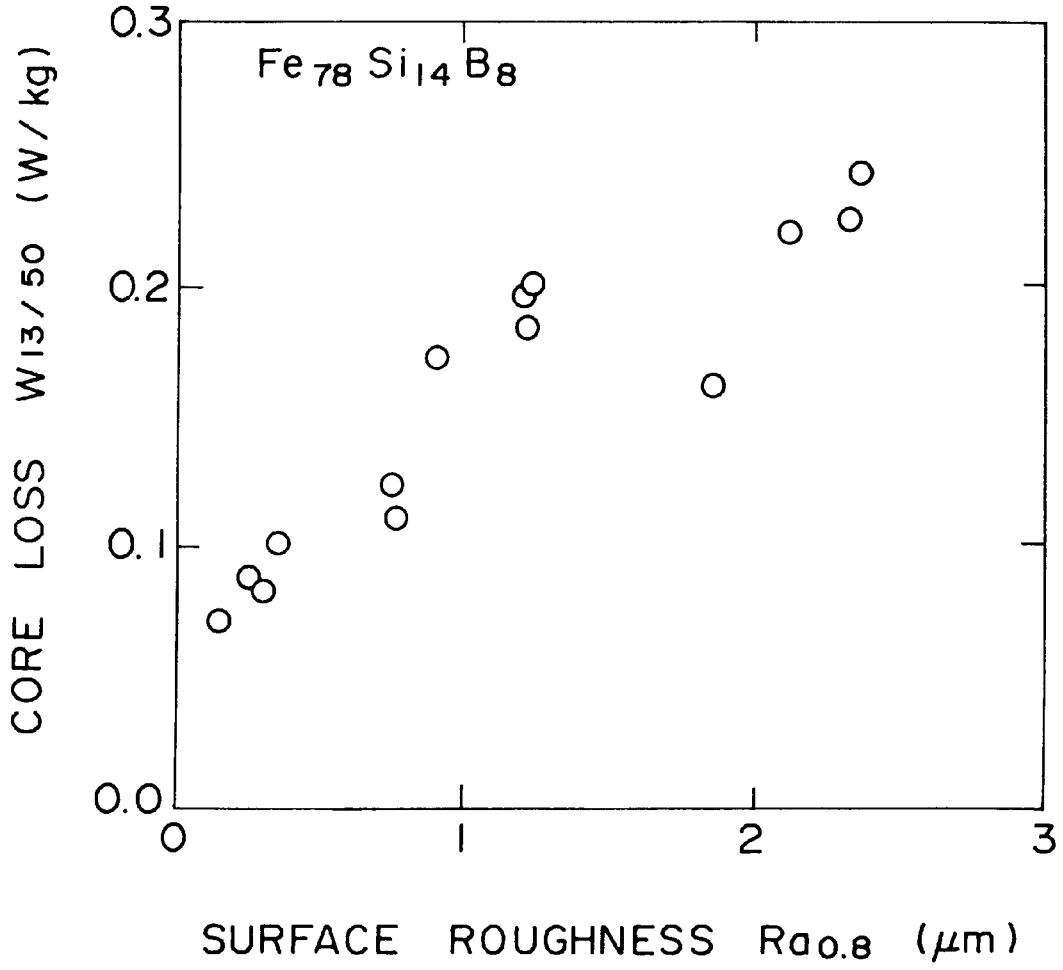
FIG. 5 is a graph showing the relationship between core loss and surface roughness $Ra_{0.8}$ of an amorphous alloy $Fe_{78}Si_{14}B_8$.
Figure 6:
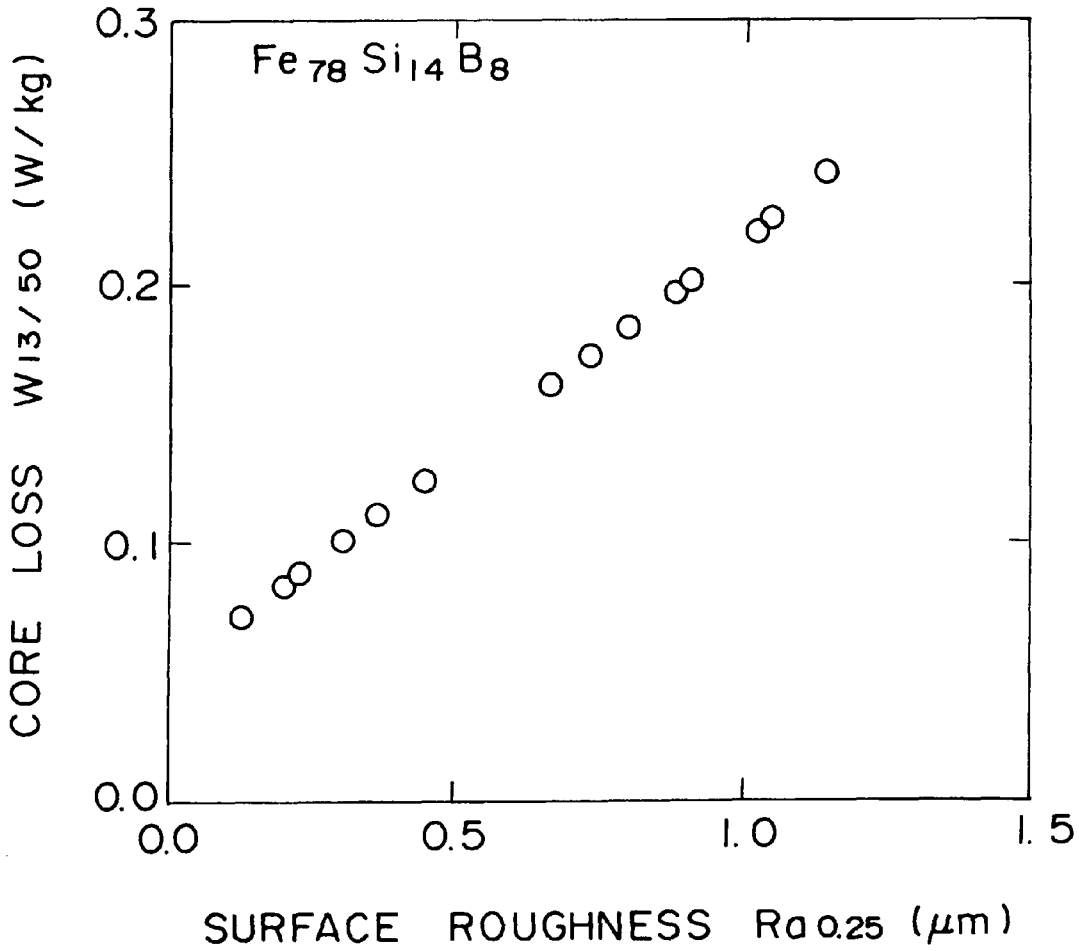
FIG. 6 is a graph showing the relationship between core loss and surface roughness $Ra_{0.25}$ of the amorphous alloy having the formula $Fe_{78}Si_{14}B_8$.

Shown in FIGS. 4, 5 and 6, respectively are results obtained by investigating relationships of core loss with center line average roughness observed when the cut-off value was set at 2.5 mm, 0.8 mm and 0.25 mm in the amorphous alloy (plate thickness: 20 μm) having a composition of $Fe_{78}Si_{14}B_8$.

In the case of the cut-off value of 2.5 mm shown in FIG. 4, no correlation was observed between the surface roughness $Ra_{2.5}$ and the core loss value. When the cut-off value was reduced to 0.8 mm, a rather strong correlation was observed, as shown in FIG. 5. However, some scattering was still found.

In contrast with this, when the cut-off value was set at 0.25 mm, a very good correlation of the surface roughness $Ra_{0.25}$ with the core loss value was clearly observed, as shown in FIG. 6.

It is considered that correlation of surface roughness with core loss varies according to the cut-off value because steep undulations such as air pockets (diameter: 10 to 20 μm and depth: 1 to 3 μm) on a ribbon surface contribute as a pinning site for magnetic domain walls, and that since loose undulations such as fluctuation of the plate thickness and waviness (wavelength: 1 to 2 mm and depth: 2 to 3 μm) on the surface at different parts of the sample do not cause sudden changes in magnetostatic energy, and do not contribute as many pinning sites for magnetic domain walls.

In the present invention, the center line average roughness which is used for evaluating surface roughness is expressed in a standard manner in terms of the size of an area. That area is surrounded by the undulations on the surface and by a standard line positioned by connecting two points present on the face which is a basis for measurement. The distance between these two points is called the cut-off value.

When the measurement is carried out at a large cut-off value, the large average roughness is shown by a long-period waviness on the surface also in a sample in which air pockets are not present. Accordingly, the measurement at such a large cut-off value is believed not to necessarily reflect the presence of the air pockets.

Accordingly, it is considered that the measured results obtained at such large cut-off value as 2.5 mm and 0.8 mm make the correlation with the core loss indistinct.

In contrast with this, it is considered that in order to evaluate only the effect of the air pockets, undulations only in the periphery of the air pocket are detected, and a small cut-off value detecting no waviness on the surface is employed. Such a small cut-off value as 0.25 mm is more suited to evaluate the presence of the air pockets than a cut-off value of 0.8 mm or more. In this way the correlation with the core loss can more clearly be observed.

Next, the suitable ranges of the components in the composition of the present invention shall be explained.

In the present invention, any amorphous ferrous alloys are suitable as long as they are so-called low boron-containing Fe—B—Si base amorphous alloys having a boron content of about 6–10 at %. The composition is:

B: about 6 to 10 at %

Boron is an indispensable element which enhances amorphous formability. If its content is less than about 6 at %, the effect is poor. On the other hand, an amount exceeding about 10 at % increases the content of expensive ferroboron, and increases cost. Further, a boron content exceeding about 10 at % decreases dependency of the core loss on the surface roughness and decreases the benefit of controlling surface roughness. Accordingly, the boron content of the alloy lies within a range of about 6 to 10 at %, preferably about 6 to 8 at %.

Si: about 10 to 17 at %

Si contributes effectively to reduction of magnetostriction and increase of thermal stability. An Si content of less than about 10 at % provides a poor effect. On the other hand, Si exceeding about 17 at % causes problem embrittlement of the ribbon. Accordingly, the Si content falls preferably in the range of about 10 to 17 at %.

Further, although the present invention consists essentially of Fe, Si and B, components such as C, Mn and P can suitably be added to the Fe—B—Si base amorphous alloy. Suitable compositions fall in the following ranges:

C: about 0.1 to 2 at %

C is an element which is effective for elevating amorphous formability and improving flux density and core loss. A C content of less than about 0.1 at % provides a poor addition effect. On the other hand, a C content exceeding about 2 at % reduces the thermal stability of the ribbon. Accordingly, the C content falls preferably in a range of about 0.1 to 2 at %, more preferably about 0.1 to 1 at %.

Mn: 0.2 to 1.0 at %

Mn works effectively to control crystallization. An Mn content of less than about 0.2 at % provides a poor effect. On the other hand, an Mn content exceeding about 1.0 at % reduces flux density. Accordingly, the Mn content falls preferably in the range of about 0.2 to 1.0 at %, more preferably about 0.2 to 0.7 at %.

P: about 0.02 to 2 at %

P not only strengthens amorphous formability but also contributes effectively to improvement of surface roughness. A content of less than about 0.02 at % P provides no effect of improving surface roughness. On the other hand, a content exceeding about 2 at % P causes problems of embrittlement of the ribbon and reduction of thermal stability. Accordingly, the P content falls preferably in the range of about 0.02 to 2 at %. In the case of a wide material facing severe requirements regarding embrittlement and thermal stability, the P content falls preferably in a range of about 0.02 to 1 at %.

Next, a casting process according to the present invention shall be disclosed in detail.

As described previously, it is desirable in the casting process to control the surface roughness $Ra_{0.8}$ to about 0.8 $\mu$m or less, and important to control the surface roughness $Ra_{0.25}$ to about 0.3 $\mu$m or less.

We have discovered that particularly the nozzle ejection pressure and the roll peripheral speed have a substantial influence on the surface roughness of the product and that if they are controlled within the prescribed ranges, highly advantageous objectives can be achieved.

Figure 7:
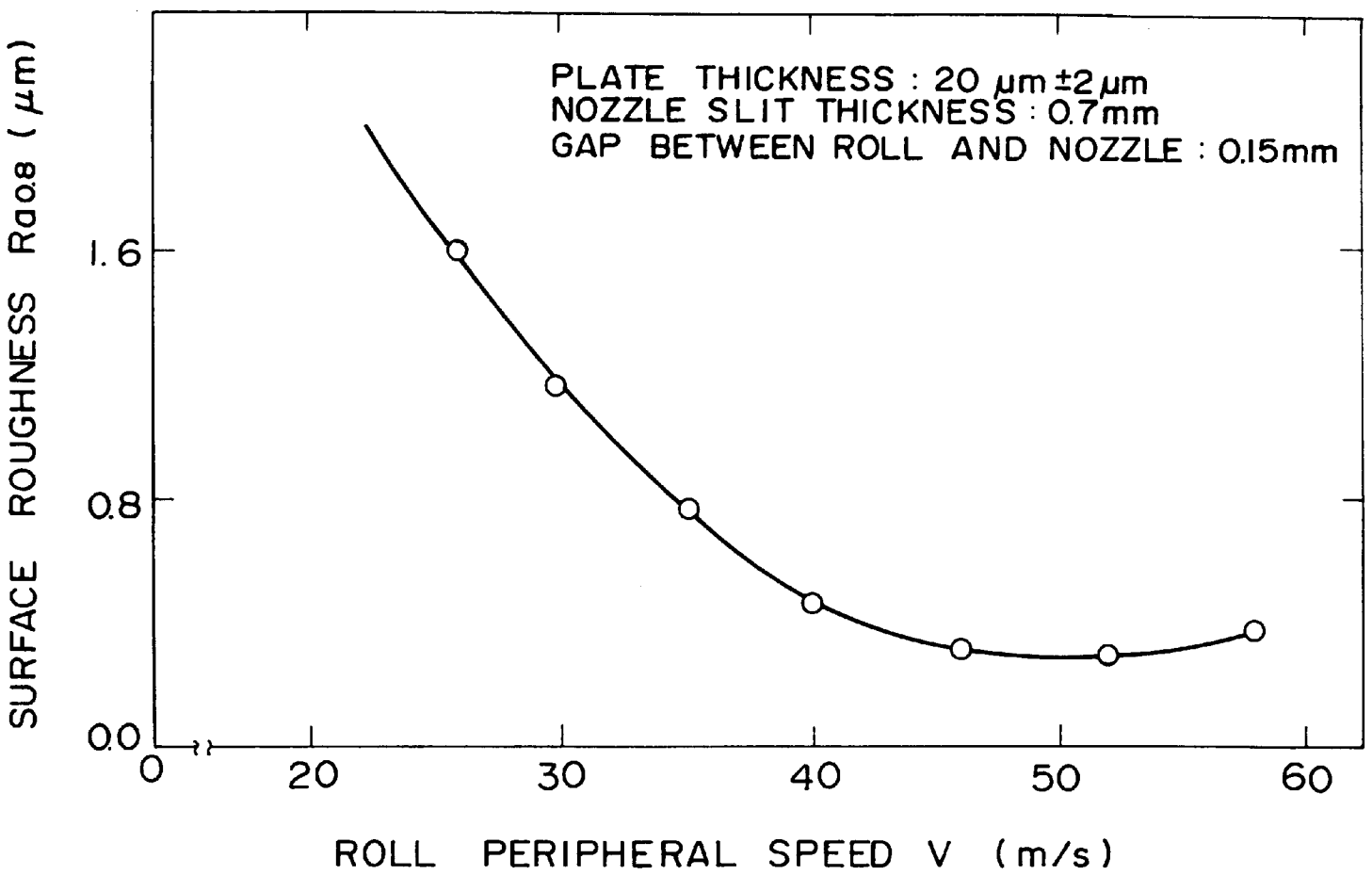
FIG. 7 is a graph showing the relationship between surface roughness $Ra_{0.8}$ and roll peripheral speed when cooling quickly to solidify a molten metal alloy having the formula $Fe_{78}Si_{14}B_8$.

Shown in FIG. 7 are the results obtained by investigating the relationship of the roll peripheral speed with the surface roughness $Ra_{0.8}$ in producing an amorphous ribbon from a molten metal of an alloy having the composition $Fe_{78}Si_{14}B_8$ by use of a single roll, wherein the roll peripheral speed and the ejection pressure are varied at the same time to provide in any case a plate thickness of 20 $\mu$m. Other production conditions were: the thickness of the slit nozzle used for the casting was about 0.7 mm and the gap between the roll and the nozzle was about 0.15 mm.

As is apparent from FIG. 7, the surface roughness $Ra_{0.8}$ decreased as the roll peripheral speed increased, and $Ra_{0.8}$ could be reduced to about 0.8 $\mu$m or less at a roll peripheral speed of about 35 m/sec or more.

Excessive roll peripheral speed increases the influence of rotational run-out and rather deteriorates the surface roughness. Accordingly, the upper practical speed limit is preferably about 50 m/sec.

Figure 8:
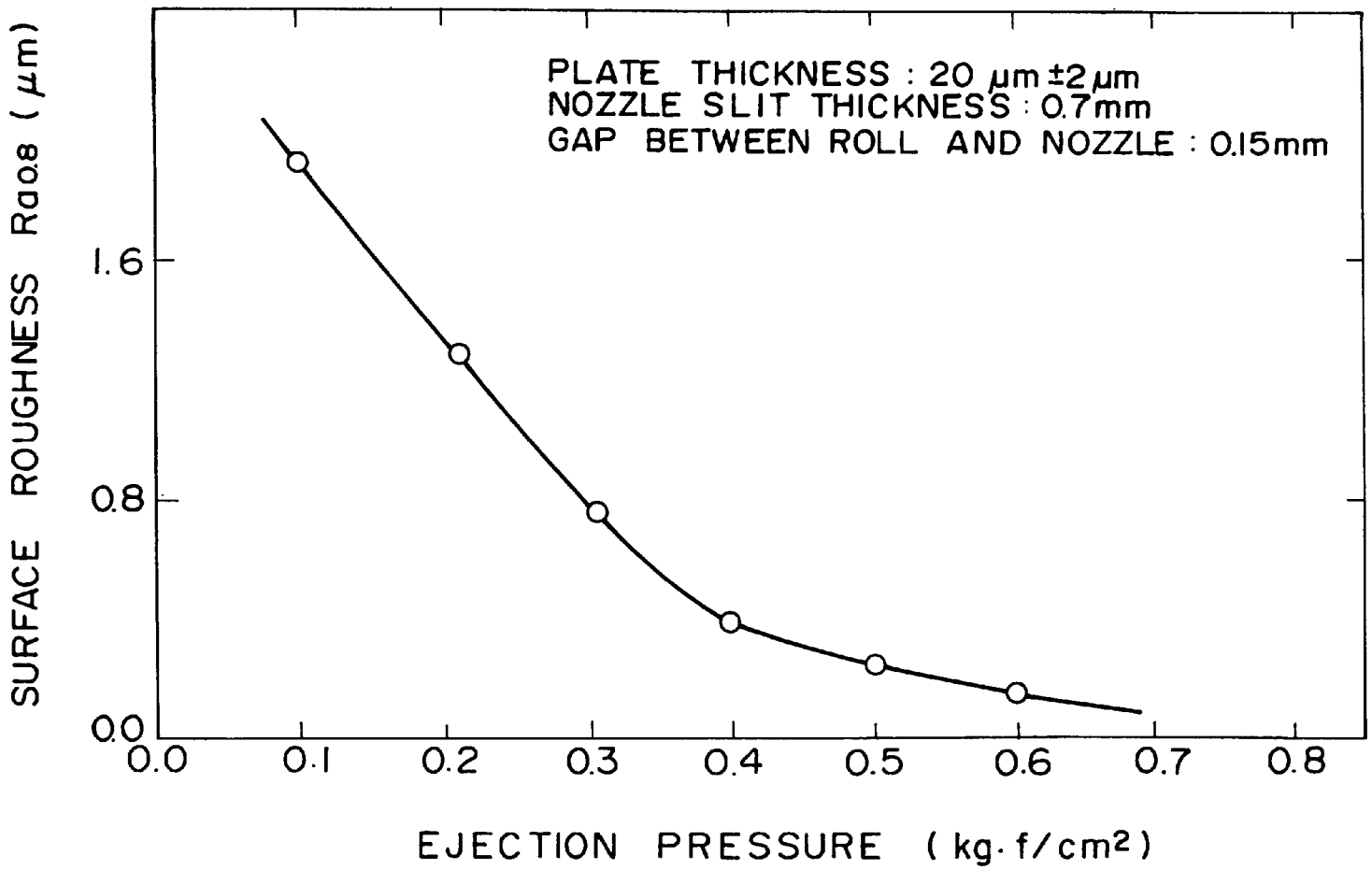
FIG. 8 is a graph showing the relationship between surface roughness $Ra_{0.8}$ and ejection pressure when continuously casting by ejection of molten meatal alloy through a nozzle and cooling quickly onto a rotating roll to solidify the molten metal alloy having the formula $Fe_{78}Si_{14}B_8$.

FIG. 8 shows the relation of nozzle ejection pressure to surface roughness $Ra_{0.8}$ in producing an amorphous ribbon under the same conditions as those in FIG. 7.

As is apparent from FIG. 8, the surface roughness $Ra_{0.8}$ decreased as the ejection pressure increased, and $Ra_{0.8}$ could be lowered down to about 0.8 $\mu$m or less at an ejection pressure of about 0.3 kgf/cm$^2$ or more.

However, use of an ejection pressure above about 0.6 kgf/cm$^2$ brings about a risk of puddle break. Therefore the preferred ejection pressure is about 0.3 to 0.6 kgf/cm$^2$.

As described above, the surface roughness $Ra_{0.8}$ can be reduced to about 0.8 $\mu$m or less by controlling the roll peripheral speed to about 35 m/sec or more and the nozzle ejection pressure to about 0.3 to 0.6 kgf/cm2. Acceleration of roll peripheral speed is accompanied by a decrease of plate thickness. On the other hand, an increase of ejection pressure results in an increase of plate thickness. Accordingly, it is essential to control the roll peripheral speed and the ejection pressure from the ranges described above, so that the plate thickness meets the range of about 15 to 25 $\mu$m in the process of the present invention.

The nozzle slit thickness and the gap between the roll and the nozzle are important and are preferably restricted to the ranges of about 0.4 to 1.0 mm and about 0.10 to 0.20 mm, respectively.

A nozzle slit thickness of less than about 0.4 mm tends to increase the surface roughness of the ribbon produced to cause the core loss to increase. On the other hand, a nozzle slit thickness broader than about 1.0 mm causes puddle break even at an ejection pressure of about 0.3 kgf/cm$^2$ or less. Plate making at a higher ejection pressure may be impossible.

When the gap between the roll and the nozzle is less than about 0.1 mm, the surface roughness of the ribbon produced is increased and this increases the core loss. Meanwhile, where the same gap is wider than about 0.2 mm, there is the significant risk that plate making at high ejection pressure is impossible.

Thus, an amorphous ribbon having an excellent core loss ($W_{13/50}$) of 0.15 W/kg or less with a scattering of 0.03 W/kg or less in terms of standard deviation can be obtained reliably by controlling the plate thickness to about 15 to 25 $\mu$m and the surface roughness to about 0.8 $\mu$m or less in terms of $Ra_{0.8}$.

Further, controlling the surface roughness to about 0.3 $\mu$m or less in terms of $Ra_{0.25}$ makes it possible to reduce scattering in the core loss to about 0.02 W/kg or less in terms of standard deviation, and is very advantageous.

We have found that the surface roughness of the amorphous alloy is influenced as well by the casting environment. Maintaining a $CO_2$ concentration of about 50% or more in the environment is very effective for improving surface roughness.

Figure 9:
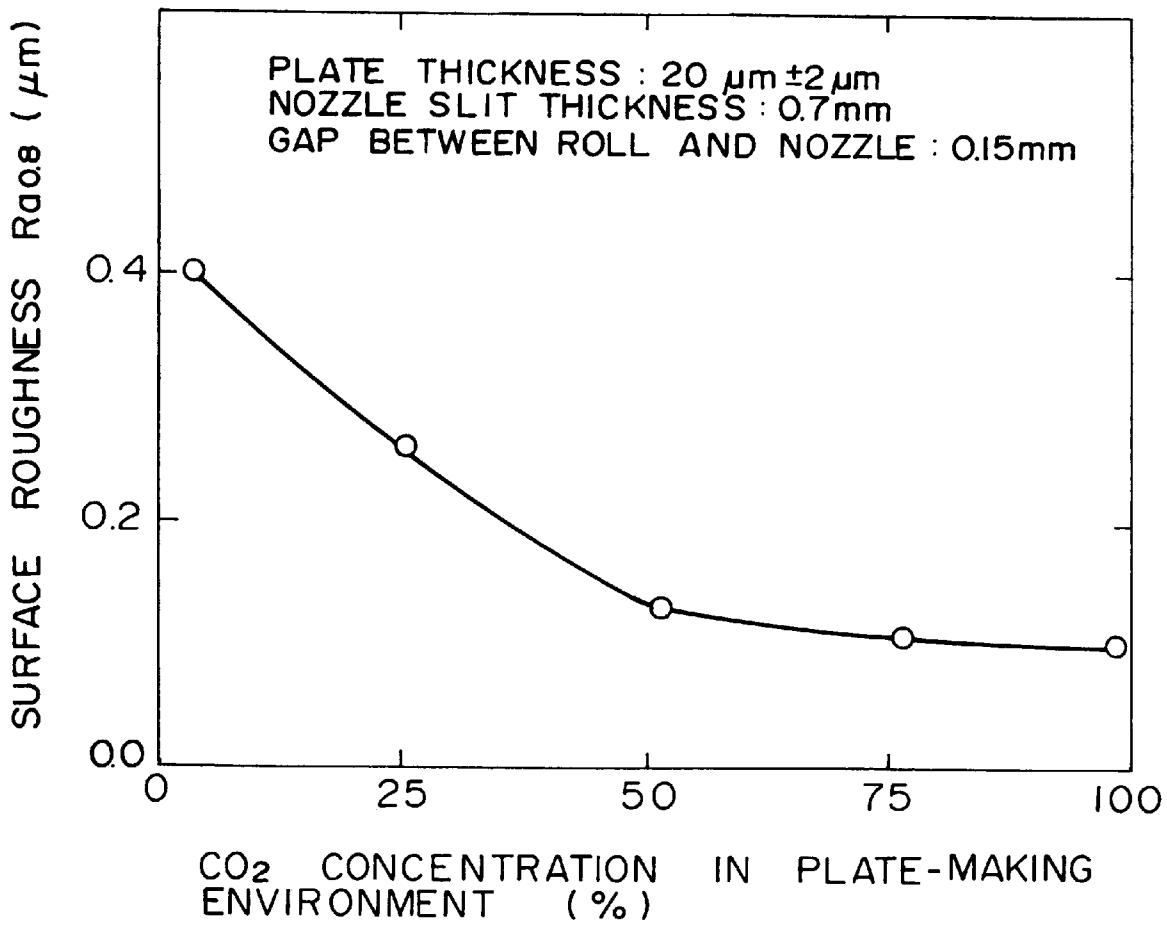
FIG. 9 is a graph showing the relationship between surface roughness $Ra_{0.8}$ with $CO_2$ concentration in the environment when casting by ejection and cooling quickly to solidify a molten amorphous alloy having the formula $Fe_{78}Si_{14}B_8$.

Shown in FIG. 9 are the results obtained by investigating the relationship of the $CO_2$ concentration in the environment with the surface roughness $Ra_{0.8}$ in producing the amorphous ribbon by quickly cooling and solidifying the molten metal of an alloy having a composition of $Fe_{78}Si_{14}B_8$. The roll peripheral speed was 35 m/sec, the ejection pressure was 0.4 kgf/cm$^2$, the thickness of the slit nozzle was 0.7 mm and the roll-nozzle gap was 0.15 mm.

As is apparent from FIG. 9, the surface roughness $Ra_{0.8}$ was successfully lowered further by controlling the $CO_2$ concentration in the environment to about 50% or more.

EXAMPLE 1

Molten metals of various Fe—Si—B base alloys having the compositions shown in Tables 1 to 3 were quickly cooled and solidified under the conditions shown in Table 1–3 to prepare amorphous ribbons.

Plate thicknesses, surface roughnesses, core losses and flux densities of the thin plates thus obtained are shown together in Tables 1 to 3.

As is apparent from the results summarized in the above tables, while the amorphous ribbons obtained according to the present invention had low boron contents, they provided core loss properties equivalent to or better than those of conventional boron-containing amorphous ribbons.

Thus, in the low boron-containing Fe—Si—B base amorphous alloy having a boron content of 10 at % or less, (about 6–10 at %), the excellent core loss properties stood well in comparison with those of conventional high boron-containing Fe—Si—B base amorphous alloys, and were stably obtained in the process according to the present invention.

EXAMPLE 2

Molten metals of various Fe—Si—B base alloys having the compositions shown in Tables 4 to 9 were quickly cooled and solidified and thereby cast under the conditions shown in Table 4–9 to prepare amorphous ribbons.

The plate thicknesses, surface roughnesses, core losses and flux densities of the thin plates that were obtained are shown together in Tables 4 to 9.

As is apparent from the results summarized in the above tables, while the amorphous ribbons obtained according to the present invention had low boron contents, they provided core loss properties which were as good or better than those of conventional low boron-containing amorphous ribbons but were much less expensive because of significant conservation of valuable boron.

Thus, in low boron Fe—Si—B base amorphous alloy having a boron content of about 10 at % or less, particularly about 6–10 at %, the excellent core loss properties stood well in comparison with conventional high boron-containing Fe—Si—B base amorphous alloys; they were stably produced according to the novel process of the present invention.

TABLE 1

| a | b | c | Plate thickness (μm) | Surface roughness (μm) $Ra_{0.8}$ | Surface roughness (μm) $Ra_{0.25}$ | Core loss $W_{13/50}$ (W/kg) | Flux density $B_8$ (T) | $CO_2$ concentration (%) | Roll peripheral speed (m/s) | Gap (mm) | Slit thickness (mm) | Ejection pressure (kgf/cm$_2$) |
|---|---|---|---|---|---|---|---|---|---|---|---|---|
| Composition $Fe_{78}Si_{14}B_6$ . . . Example of this Invention | | | | | | | | | | | | |
| 0 | 0.003 | 0.09 | 15 | 0.12 | 0.03 | 0.0558 | 1.52 | 100 | 50 | 0.15 | 0.5 | 0.3 |
| 0 | 0.003 | 0.09 | 15 | 0.30 | 0.13 | 0.072 | 1.53 | 40 | 50 | 0.15 | 0.5 | 0.3 |
| 0 | 0.003 | 0.09 | 15 | 0.79 | 0.40 | 0.1161 | 1.54 | 0 | 50 | 0.15 | 0.5 | 0.3 |
| 0 | 0.003 | 0.09 | 20 | 0.11 | 0.10 | 0.0699 | 1.54 | 95 | 40 | 0.15 | 0.5 | 0.3 |
| 0 | 0.003 | 0.09 | 20 | 0.31 | 0.23 | 0.0879 | 1.53 | 45 | 40 | 0.15 | 0.5 | 0.3 |
| 0 | 0.003 | 0.09 | 20 | 0.69 | 0.43 | 0.1221 | 1.53 | 0 | 40 | 0.15 | 0.5 | 0.3 |
| 0 | 0.003 | 0.09 | 25 | 0.13 | 0.10 | 0.0867 | 1.54 | 90 | 35 | 0.15 | 0.5 | 0.3 |
| 0 | 0.003 | 0.09 | 25 | 0.32 | 0.32 | 0.1038 | 1.54 | 35 | 35 | 0.15 | 0.5 | 0.3 |
| 0 | 0.003 | 0.09 | 25 | 0.78 | 0.57 | 0.1452 | 1.54 | 0 | 35 | 0.15 | 0.5 | 0.3 |
| Composition $Fe_{78}Si_{12}B_{10}$ . . . Example of this Invention | | | | | | | | | | | | |
| 0.01 | 0.003 | 0.08 | 15 | 0.14 | 0.10 | 0.0662 | 1.54 | 90 | 35 | 0.10 | 0.5 | 0.4 |
| 0.01 | 0.003 | 0.08 | 15 | 0.35 | 0.20 | 0.083 | 1.54 | 30 | 35 | 0.10 | 0.5 | 0.4 |
| 0.01 | 0.003 | 0.08 | 15 | 0.65 | 0.34 | 0.107 | 1.53 | 0 | 35 | 0.10 | 0.5 | 0.4 |
| 0.01 | 0.003 | 0.08 | 20 | 0.10 | 0.09 | 0.078 | 1.53 | 95 | 40 | 0.15 | 0.5 | 0.4 |
| 0.01 | 0.003 | 0.08 | 20 | 0.32 | 0.27 | 0.0956 | 1.54 | 45 | 40 | 0.15 | 0.5 | 0.4 |
| 0.01 | 0.003 | 0.08 | 20 | 0.77 | 0.49 | 0.1316 | 1.52 | 0 | 40 | 0.15 | 0.5 | 0.4 |
| 0.01 | 0.003 | 0.08 | 25 | 0.12 | 0.10 | 0.0946 | 1.53 | 85 | 35 | 0.15 | 0.5 | 0.4 |
| 0.01 | 0.003 | 0.08 | 25 | 0.36 | 0.35 | 0.1138 | 1.54 | 40 | 35 | 0.15 | 0.5 | 0.4 |
| 0.01 | 0.003 | 0.08 | 25 | 0.78 | 0.58 | 0.1474 | 1.54 | 0 | 35 | 0.15 | 0.5 | 0.4 |
| Composition $Fe_{78}Si_{12}B_9C_1$ . . . Example of this Invention | | | | | | | | | | | | |
| 0.02 | 0.003 | 0.06 | 15 | 0.14 | 0.12 | 0.0734 | 1.52 | 100 | 50 | 0.15 | 0.5 | 0.3 |
| 0.02 | 0.003 | 0.06 | 15 | 0.35 | 0.22 | 0.086 | 1.52 | 35 | 50 | 0.15 | 0.5 | 0.3 |
| 0.02 | 0.003 | 0.06 | 15 | 0.72 | 0.35 | 0.1082 | 1.53 | 0 | 50 | 0.15 | 0.5 | 0.3 |
| 0.02 | 0.003 | 0.06 | 20 | 0.16 | 0.15 | 0.0896 | 1.54 | 95 | 50 | 0.15 | 0.5 | 0.4 |
| 0.02 | 0.003 | 0.06 | 20 | 0.31 | 0.29 | 0.0986 | 1.54 | 40 | 50 | 0.15 | 0.5 | 0.4 |
| 0.02 | 0.003 | 0.06 | 20 | 0.74 | 0.45 | 0.1244 | 1.53 | 0 | 40 | 0.15 | 0.5 | 0.36 |
| 0.02 | 0.003 | 0.06 | 25 | 0.13 | 0.10 | 0.1028 | 1.53 | 85 | 40 | 0.15 | 0.5 | 0.56 |
| 0.02 | 0.003 | 0.06 | 25 | 0.35 | 0.30 | 0.116 | 1.54 | 45 | 40 | 0.15 | 0.5 | 0.56 |
| 0.02 | 0.003 | 0.06 | 25 | 0.78 | 0.55 | 0.1418 | 1.52 | 0 | 40 | 0.15 | 0.5 | 0.56 |

TABLE 2

| a | b | c | Plate thickness (μm) | Surface roughness (μm) $Ra_{0.8}$ | Surface roughness (μm) $Ra_{0.25}$ | Core loss $W_{13/50}$ (W/kg) | Flux density $B_8$ (T) | $CO_2$ concentration (%) | Roll peripheral speed (m/s) | Gap (mm) | Slit thickness (mm) | Ejection pressure ($kgf/cm_2$) |
|---|---|---|---|---|---|---|---|---|---|---|---|---|
| Composition $Fe_{78}Si_{13.5}B_8Mn_{0.5}$ . . . Example of this Invention | | | | | | | | | | | | |
| 0 | 0.003 | 0.09 | 15 | 0.11 | 0.03 | 0.0549 | 1.53 | 90 | 50 | 0.15 | 0.4 | 0.3 |
| 0 | 0.003 | 0.09 | 15 | 0.29 | 0.13 | 0.0711 | 1.54 | 40 | 50 | 0.15 | 0.4 | 0.3 |
| 0 | 0.003 | 0.09 | 15 | 0.70 | 0.35 | 0.108 | 1.52 | 0 | 50 | 0.15 | 0.4 | 0.3 |
| 0 | 0.003 | 0.09 | 20 | 0.11 | 0.09 | 0.0699 | 1.52 | 95 | 50 | 0.15 | 0.6 | 0.3 |
| 0 | 0.003 | 0.09 | 20 | 0.26 | 0.20 | 0.0834 | 1.52 | 30 | 50 | 0.15 | 0.6 | 0.3 |
| 0 | 0.003 | 0.09 | 20 | 0.76 | 0.47 | 0.1284 | 1.53 | 0 | 50 | 0.15 | 0.6 | 0.3 |
| 0 | 0.003 | 0.09 | 25 | 0.12 | 0.10 | 0.0858 | 1.54 | 90 | 50 | 0.15 | 0.8 | 0.3 |
| 0 | 0.003 | 0.09 | 25 | 0.36 | 0.34 | 0.1074 | 1.54 | 35 | 50 | 0.15 | 0.8 | 0.3 |
| 0 | 0.003 | 0.09 | 25 | 0.74 | 0.55 | 0.1416 | 1.53 | 0 | 50 | 0.15 | 0.8 | 0.3 |
| Composition $Fe_{78}Si_{12.5}B_9Mn_{0.5}$ . . . Example of this Invention | | | | | | | | | | | | |
| 0.01 | 0.003 | 0.08 | 15 | 0.16 | 0.11 | 0.0678 | 1.52 | 100 | 50 | 0.15 | 0.5 | 0.3 |
| 0.01 | 0.003 | 0.08 | 15 | 0.38 | 0.21 | 0.0854 | 1.52 | 35 | 50 | 0.15 | 0.5 | 0.3 |
| 0.01 | 0.003 | 0.08 | 15 | 0.76 | 0.39 | 0.1158 | 1.53 | 0 | 50 | 0.15 | 0.5 | 0.3 |
| 0.01 | 0.003 | 0.08 | 20 | 0.12 | 0.10 | 0.0796 | 1.54 | 95 | 40 | 0.15 | 0.5 | 0.3 |
| 0.01 | 0.003 | 0.08 | 20 | 0.26 | 0.24 | 0.0908 | 1.54 | 45 | 40 | 0.15 | 0.5 | 0.3 |
| 0.01 | 0.003 | 0.08 | 20 | 0.79 | 0.50 | 0.1332 | 1.53 | 0 | 40 | 0.15 | 0.5 | 0.3 |
| 0.01 | 0.003 | 0.08 | 25 | 0.11 | 0.10 | 0.0938 | 1.53 | 90 | 35 | 0.15 | 0.5 | 0.3 |
| 0.01 | 0.003 | 0.08 | 25 | 0.31 | 0.30 | 0.1098 | 1.54 | 45 | 35 | 0.15 | 0.5 | 0.3 |
| 0.01 | 0.003 | 0.08 | 25 | 0.75 | 0.57 | 0.145 | 1.52 | 0 | 35 | 0.15 | 0.5 | 0.3 |
| Composition $Fe_{78}Si_{11.5}B_{10}Mn_{0.5}$ . . . Example of this Invention | | | | | | | | | | | | |
| 0.02 | 0.003 | 0.06 | 15 | 0.10 | 0.09 | 0.071 | 1.53 | 90 | 35 | 0.10 | 0.5 | 0.4 |
| 0.02 | 0.003 | 0.06 | 15 | 0.30 | 0.20 | 0.083 | 1.53 | 40 | 35 | 0.10 | 0.5 | 0.4 |
| 0.02 | 0.003 | 0.06 | 15 | 0.76 | 0.36 | 0.1106 | 1.54 | 0 | 35 | 0.10 | 0.5 | 0.4 |
| 0.02 | 0.003 | 0.06 | 20 | 0.14 | 0.12 | 0.0884 | 1.52 | 95 | 40 | 0.15 | 0.5 | 0.4 |
| 0.02 | 0.003 | 0.06 | 20 | 0.35 | 0.31 | 0.101 | 1.53 | 40 | 40 | 0.15 | 0.5 | 0.4 |
| 0.02 | 0.003 | 0.06 | 20 | 0.74 | 0.45 | 0.1244 | 1.54 | 0 | 40 | 0.15 | 0.5 | 0.4 |
| 0.02 | 0.003 | 0.06 | 25 | 0.15 | 0.13 | 0.104 | 1.53 | 85 | 35 | 0.15 | 0.5 | 0.5 |
| 0.02 | 0.003 | 0.06 | 25 | 0.36 | 0.35 | 0.1166 | 1.54 | 40 | 35 | 0.15 | 0.5 | 0.5 |
| 0.02 | 0.003 | 0.06 | 25 | 0.79 | 0.55 | 0.1424 | 1.54 | 0 | 35 | 0.15 | 0.5 | 0.5 |

TABLE 3

| a | b | c | Plate thickness (μm) | Surface roughness (μm) $Ra_{0.8}$ | Surface roughness (μm) $Ra_{0.25}$ | Core loss $W_{13/50}$ (W/kg) | Flux density $B_8$ (T) | $CO_2$ concentration (%) | Roll peripheral speed (m/s) | Gap (mm) | Slit thickness (mm) | Ejection pressure ($kgf/cm_2$) |
|---|---|---|---|---|---|---|---|---|---|---|---|---|
| Composition $Fe_{78}Si_{14}B_8$ . . . Comparative Example | | | | | | | | | | | | |
| 0 | 0.003 | 0.09 | 10 | 2.11 | 1.02 | 0.2199 | 1.52 | 5 | 30 | 0.15 | 0.5 | 0.05 |
| 0 | 0.003 | 0.09 | 30 | 0.84 | 0.69 | 0.1656 | 1.52 | 55 | 20 | 0.15 | 0.5 | 0.2 |
| 0 | 0.003 | 0.09 | 30 | 1.53 | 1.07 | 0.2277 | 1.52 | 10 | 20 | 0.15 | 0.5 | 0.2 |
| Composition $Fe_{78}Si_{12}B_{10}$ . . . Comparative Example | | | | | | | | | | | | |
| 0.01 | 0.003 | 0.08 | 10 | 2.30 | 1.04 | 0.224 | 1.53 | 0 | 45 | 0.15 | 0.5 | 0.1 |
| 0.01 | 0.003 | 0.08 | 30 | 0.82 | 0.69 | 0.1656 | 1.54 | 60 | 30 | 0.15 | 0.8 | 0.2 |
| 0.01 | 0.003 | 0.08 | 30 | 1.20 | 0.88 | 0.196 | 1.54 | 0 | 20 | 0.15 | 0.5 | 0.2 |
| Composition $Fe_{78}Si_{12}B_9C_1$ . . . Comparative Example | | | | | | | | | | | | |
| 0.02 | 0.003 | 0.06 | 10 | 2.35 | 0.85 | 0.191 | 1.53 | 0 | 30 | 0.15 | 0.5 | 0.05 |
| 0.02 | 0.003 | 0.06 | 30 | 0.85 | 0.67 | 0.161 | 1.54 | 50 | 20 | 0.15 | 0.5 | 0.2 |
| 0.02 | 0.003 | 0.06 | 30 | 1.21 | 0.80 | 0.1826 | 1.54 | 10 | 20 | 0.15 | 0.5 | 0.2 |
| Composition $Fe_{78}Si_{13.5}B_8Mn_{0.5}$ . . . Comparative Example | | | | | | | | | | | | |
| 0 | 0.003 | 0.09 | 10 | 2.35 | 1.15 | 0.2415 | 1.54 | 0 | 45 | 0.15 | 0.5 | 0.1 |
| 0 | 0.003 | 0.09 | 30 | 0.81 | 0.68 | 0.1629 | 1.53 | 55 | 30 | 0.15 | 0.8 | 0.2 |
| 0 | 0.003 | 0.09 | 30 | 1.23 | 0.90 | 0.2007 | 1.53 | 5 | 20 | 0.15 | 0.5 | 0.2 |
| Composition $Fe_{78}Si_{12.5}B_9Mn_{0.5}$ . . . Comparative Example | | | | | | | | | | | | |
| 0.01 | 0.003 | 0.08 | 10 | 2.31 | 1.05 | 0.2248 | 1.52 | 0 | 30 | 0.15 | 0.5 | 0.05 |
| 0.01 | 0.003 | 0.08 | 30 | 0.90 | 0.73 | 0.172 | 1.53 | 60 | 20 | 0.15 | 0.5 | 0.2 |
| 0.01 | 0.003 | 0.08 | 30 | 1.20 | 0.88 | 0.196 | 1.54 | 0 | 20 | 0.15 | 0.5 | 0.2 |

TABLE 3-continued

| a | b | c | Plate thickness (μm) | Surface roughness (μm) $Ra_{0.8}$ | Surface roughness (μm) $Ra_{0.25}$ | Core loss $W_{13/50}$ (W/kg) | Flux density $B_8$ (T) | $CO_2$ concentration (%) | Roll peripheral speed (m/s) | Gap (mm) | Slit thickness (mm) | Ejection pressure ($kgf/cm_2$) |
|---|---|---|---|---|---|---|---|---|---|---|---|---|
| Composition $Fe_{78}Si_{11.5}B_{10}Mn_{0.5}$ . . . Comparative Example | | | | | | | | | | | | |
| 0.02 | 0.003 | 0.06 | 10 | 2.40 | 0.86 | 0.194 | 1.53 | 0 | 45 | 0.15 | 0.5 | 0.1 |
| 0.02 | 0.003 | 0.06 | 30 | 0.95 | 0.70 | 0.167 | 1.54 | 50 | 30 | 0.15 | 0.8 | 0.2 |
| 0.02 | 0.003 | 0.06 | 30 | 1.26 | 0.81 | 0.1856 | 1.52 | 5 | 20 | 0.15 | 0.5 | 0.2 |

TABLE 4

| Composition | plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure ($kgf/cm^2$) |
|---|---|---|---|---|---|---|---|---|
| Example of this invention | | | | | | | | |
| $Fe_{76}Si_{18}B_6$ | 16 | 0.18 | 0.08 | 1.49 | 50 | 0.1 | 1.0 | 0.3 |
| $Fe_{76}Si_{18}B_6$ | 15 | 0.20 | 0.083 | 1.50 | 50 | 0.2 | 0.6 | 0.3 |
| $Fe_{76}Si_{18}B_6$ | 15 | 0.19 | 0.081 | 1.49 | 35 | 0.1 | 0.6 | 0.3 |
| $Fe_{76}Si_{18}B_6$ | 20 | 0.20 | 0.084 | 1.5 | 35 | 0.1 | 1.0 | 0.3 |
| $Fe_{76}Si_{18}B_6$ | 18 | 0.19 | 0.082 | 1.51 | 50 | 0.1 | 1 | 0.4 |
| $Fe_{76}Si_{18}B_6$ | 20 | 0.21 | 0.085 | 1.5 | 50 | 0.2 | 0.6 | 0.4 |
| $Fe_{76}Si_{18}B_6$ | 20 | 0.20 | 0.083 | 1.51 | 35 | 0.1 | 0.6 | 0.4 |
| $Fe_{76}Si_{18}B_6$ | 19 | 0.18 | 0.080 | 1.51 | 50 | 0.1 | 0.6 | 0.5 |
| $Fe_{76}Si_{18}B_6$ | 22 | 0.19 | 0.081 | 1.51 | 50 | 0.1 | 1 | 0.5 |
| $Fe_{76}Si_{18}B_6$ | 22 | 0.19 | 0.082 | 1.51 | 50 | 0.2 | 0.6 | 0.5 |
| $Fe_{76}Si_{18}B_6$ | 20 | 0.17 | 0.079 | 1.51 | 35 | 0.1 | 0.6 | 0.5 |
| $Fe_{76}Si_{18}B_6$ | 21 | 0.17 | 0.078 | 1.51 | 50 | 0.1 | 0.6 | 0.6 |
| $Fe_{76}Si_{17}B_7$ | 15 | 0.19 | 0.081 | 1.5 | 50 | 0.1 | 1 | 0.3 |
| $Fe_{76}Si_{17}B_7$ | 17 | 0.21 | 0.085 | 1.5 | 50 | 0.2 | 0.6 | 0.3 |
| $Fe_{76}Si_{17}B_7$ | 16 | 0.20 | 0.084 | 1.5 | 35 | 0.1 | 0.6 | 0.3 |
| $Fe_{76}Si_{17}B_7$ | 20 | 0.21 | 0.685 | 1.5 | 35 | 0.1 | 1 | 0.3 |
| $Fe_{76}Si_{17}B_7$ | 20 | 0.20 | 0.084 | 1.51 | 50 | 0.1 | 1 | 0.4 |
| $Fe_{76}Si_{17}B_7$ | 19 | 0.22 | 0.086 | 1.5 | 50 | 0.2 | 0.6 | 0.4 |
| $Fe_{76}Si_{17}B_7$ | 20 | 0.20 | 0.083 | 1.51 | 35 | 0.1 | 0.6 | 0.4 |
| $Fe_{76}Si_{17}B_7$ | 20 | 0.17 | 0.078 | 1.51 | 50 | 0.1 | 0.6 | 0.5 |
| $Fe_{76}Si_{17}B_7$ | 22 | 0.17 | 0.079 | 1.51 | 50 | 0.1 | 1 | 0.5 |
| $Fe_{76}Si_{17}B_7$ | 21 | 0.18 | 0.08 | 1.51 | 50 | 0.2 | 0.6 | 0.5 |
| $Fe_{76}Si_{17}B_7$ | 20 | 0.17 | 0.079 | 1.51 | 35 | 0.1 | 0.6 | 0.5 |
| $Fe_{76}Si_{17}B_7$ | 20 | 0.16 | 0.077 | 1.51 | 50 | 0.1 | 0.6 | 0.6 |
| $Fe_{77}Si_{17}B_6$ | 16 | 0.19 | 0.082 | 1.51 | 50 | 0.1 | 1 | 0.3 |
| $Fe_{77}Si_{17}B_6$ | 15 | 0.22 | 0.086 | 1.51 | 50 | 0.2 | 0.6 | 0.3 |
| $Fe_{77}Si_{17}B_6$ | 17 | 0.21 | 0.085 | 1.52 | 35 | 0.1 | 0.6 | 0.3 |
| $Fe_{77}Si_{17}B_6$ | 20 | 0.21 | 0.085 | 1.52 | 35 | 0.1 | 1 | 0.3 |
| $Fe_{77}Si_{17}B_6$ | 18 | 0.22 | 0.086 | 1.52 | 50 | 0.1 | 1 | 0.4 |
| $Fe_{77}Si_{17}B_6$ | 20 | 0.22 | 0.087 | 1.53 | 50 | 0.2 | 0.6 | 0.4 |
| $Fe_{77}Si_{17}B_6$ | 20 | 0.20 | 0.084 | 1.52 | 35 | 0.1 | 0.6 | 0.4 |
| $Fe_{77}Si_{17}B_6$ | 18 | 0.17 | 0.079 | 1.53 | 50 | 0.1 | 0.6 | 0.5 |
| $Fe_{77}Si_{17}B_6$ | 22 | 0.18 | 0.08 | 1.53 | 50 | 0.1 | 1 | 0.5 |
| $Fe_{77}Si_{17}B_6$ | 22 | 0.19 | 0.081 | 1.52 | 50 | 0.2 | 0.6 | 0.5 |
| $Fe_{77}Si_{17}B_6$ | 20 | 0.18 | 0.08 | 1.53 | 35 | 0.1 | 0.6 | 0.5 |
| $Fe_{77}Si_{17}B_6$ | 21 | 0.17 | 0.079 | 1.53 | 50 | 0.1 | 0.6 | 0.6 |

TABLE 5

| Composition | plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure ($kgf/cm^2$) |
|---|---|---|---|---|---|---|---|---|
| Example of this invention | | | | | | | | |
| $Fe_{77}Si_{16}B_7$ | 15 | 0.19 | 0.081 | 1.52 | 50 | 0.1 | 1 | 0.3 |
| $Fe_{77}Si_{16}B_7$ | 15 | 0.20 | 0.084 | 1.52 | 50 | 0.2 | 0.6 | 0.3 |
| $Fe_{77}Si_{16}B_7$ | 16 | 0.19 | 0.082 | 1.53 | 35 | 0.1 | 0.6 | 0.3 |
| $Fe_{77}Si_{16}B_7$ | 20 | 0.21 | 0.685 | 1.53 | 35 | 0.1 | 0.6 | 0.3 |

TABLE 5-continued

| Composition | plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| $Fe_{77}Si_{16}B_7$ | 21 | 0.20 | 0.083 | 1.53 | 50 | 0.1 | 1 | 0.4 |
| $Fe_{77}Si_{16}B_7$ | 20 | 0.22 | 0.086 | 1.54 | 50 | 0.2 | 0.6 | 0.4 |
| $Fe_{77}Si_{16}B_7$ | 20 | 0.19 | 0.082 | 1.53 | 35 | 0.1 | 0.6 | 0.4 |
| $Fe_{77}Si_{16}B_7$ | 19 | 0.19 | 0.081 | 1.54 | 50 | 0.1 | 0.6 | 0.5 |
| $Fe_{77}Si_{16}B_7$ | 22 | 0.19 | 0.082 | 1.54 | 50 | 0.1 | 1 | 0.5 |
| $Fe_{77}Si_{16}B_7$ | 22 | 0.21 | 0.085 | 1.54 | 50 | 0.2 | 0.6 | 0.5 |
| $Fe_{77}Si_{16}B_7$ | 20 | 0.19 | 0.082 | 1.54 | 35 | 0.1 | 0.6 | 0.5 |
| $Fe_{77}Si_{16}B_7$ | 19 | 0.19 | 0.081 | 1.54 | 50 | 0.1 | 0.6 | 0.6 |
| $Fe_{78}Si_{15}B_7$ | 16 | 0.20 | 0.083 | 1.53 | 50 | 0.1 | 1 | 0.3 |
| $Fe_{78}Si_{15}B_7$ | 17 | 0.22 | 0.087 | 1.53 | 50 | 0.2 | 0.6 | 0.3 |
| $Fe_{78}Si_{15}B_7$ | 17 | 0.21 | 0.085 | 1.54 | 35 | 0.1 | 0.6 | 0.3 |
| $Fe_{78}Si_{15}B_7$ | 20 | 0.22 | 0.086 | 1.54 | 35 | 0.1 | 1 | 0.3 |
| $Fe_{78}Si_{15}B_7$ | 20 | 0.22 | 0.087 | 1.54 | 50 | 0.1 | 1 | 0.4 |
| $Fe_{78}Si_{15}B_7$ | 18 | 0.23 | 0.088 | 1.54 | 50 | 0.2 | 0.6 | 0.4 |
| $Fe_{78}Si_{15}B_7$ | 19 | 0.22 | 0.086 | 1.54 | 35 | 0.1 | 0.6 | 0.4 |
| $Fe_{78}Si_{15}B_7$ | 20 | 0.20 | 0.084 | 1.55 | 50 | 0.1 | 0.6 | 0.5 |
| $Fe_{78}Si_{15}B_7$ | 22 | 0.21 | 0.085 | 1.55 | 50 | 0.1 | 1 | 0.5 |
| $Fe_{78}Si_{15}B_7$ | 20 | 0.20 | 0.086 | 1.54 | 50 | 0.2 | 0.6 | 0.5 |
| $Fe_{78}Si_{15}B_7$ | 22 | 0.21 | 0.085 | 1.55 | 35 | 0.1 | 0.6 | 0.5 |
| $Fe_{78}Si_{15}B_7$ | 20 | 0.19 | 0.082 | 1.55 | 50 | 0.1 | 0.6 | 0.6 |
| $Fe_{76}Si_{17}B_6C_1$ | 16 | 0.19 | 0.081 | 1.51 | 50 | 0.1 | 1 | 0.3 |
| $Fe_{76}Si_{17}B_6C_1$ | 15 | 0.20 | 0.083 | 1.51 | 50 | 0.2 | 0.6 | 0.3 |
| $Fe_{76}Si_{17}B_6C_1$ | 17 | 0.19 | 0.082 | 1.5 | 35 | 0.1 | 0.6 | 0.3 |
| $Fe_{76}Si_{17}B_6C_1$ | 20 | 0.20 | 0.084 | 1.51 | 35 | 0.1 | 1 | 0.3 |
| $Fe_{76}Si_{17}B_6C_1$ | 18 | 0.19 | 0.082 | 1.51 | 50 | 0.1 | 1 | 0.4 |
| $Fe_{76}Si_{17}B_6C_1$ | 20 | 0.20 | 0.083 | 1.51 | 50 | 0.2 | 0.6 | 0.4 |
| $Fe_{76}Si_{17}B_6C_1$ | 20 | 0.19 | 0.081 | 1.51 | 35 | 0.1 | 0.6 | 0.4 |
| $Fe_{76}Si_{17}B_6C_1$ | 19 | 0.17 | 0.079 | 1.51 | 50 | 0.1 | 0.6 | 0.5 |
| $Fe_{76}Si_{17}B_6C_1$ | 22 | 0.18 | 0.08 | 1.52 | 50 | 0.1 | 1 | 0.5 |
| $Fe_{76}Si_{17}B_6C_1$ | 22 | 0.19 | 0.082 | 1.52 | 50 | 0.2 | 0.6 | 0.5 |
| $Fe_{76}Si_{17}B_6C_1$ | 20 | 0.18 | 0.08 | 1.52 | 35 | 0.1 | 0.6 | 0.5 |
| $Fe_{76}Si_{17}B_6C_1$ | 21 | 0.17 | 0.078 | 1.51 | 50 | 0.1 | 0.6 | 0.6 |

TABLE 6

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| Example of this invention | | | | | | | | |
| $Fe_{76}Si_{16}B_7C_1$ | 15 | 0.17 | 0.079 | 1.5 | 50 | 0.1 | 1 | 0.3 |
| $Fe_{76}Si_{16}B_7C_1$ | 17 | 0.19 | 0.081 | 1.51 | 50 | 0.2 | 0.6 | 0.3 |
| $Fe_{76}Si_{16}B_7C_1$ | 15 | 0.17 | 0.078 | 1.5 | 35 | 0.1 | 0.6 | 0.3 |
| $Fe_{76}Si_{16}B_7C_1$ | 19 | 0.19 | 0.081 | 1.5 | 35 | 0.1 | 1 | 0.3 |
| $Fe_{76}Si_{16}B_7C_1$ | 20 | 0.18 | 0.08 | 1.51 | 50 | 0.1 | 1 | 0.4 |
| $Fe_{76}Si_{16}B_7C_1$ | 18 | 0.19 | 0.081 | 1.51 | 50 | 0.2 | 0.6 | 0.4 |
| $Fe_{76}Si_{16}B_7C_1$ | 21 | 0.17 | 0.079 | 1.51 | 35 | 0.1 | 0.6 | 0.4 |
| $Fe_{76}Si_{16}B_7C_1$ | 20 | 0.16 | 0.077 | 1.52 | 50 | 0.1 | 0.6 | 0.5 |
| $Fe_{76}Si_{16}B_7C_1$ | 22 | 0.17 | 0.078 | 1.52 | 50 | 0.1 | 1 | 0.5 |
| $Fe_{76}Si_{16}B_7C_1$ | 20 | 0.17 | 0.079 | 1.52 | 50 | 0.2 | 0.6 | 0.5 |
| $Fe_{76}Si_{16}B_7C_1$ | 21 | 0.17 | 0.078 | 1.52 | 35 | 0.1 | 0.6 | 0.5 |
| $Fe_{76}Si_{16}B_7C_1$ | 20 | 0.16 | 0.077 | 1.51 | 50 | 0.1 | 0.6 | 0.6 |
| $Fe_{77}Si_{16}B_6C_1$ | 15 | 0.19 | 0.082 | 1.52 | 50 | 0.1 | 1 | 0.3 |
| $Fe_{77}Si_{16}B_6C_1$ | 16 | 0.20 | 0.084 | 1.51 | 50 | 0.2 | 0.6 | 0.3 |
| $Fe_{77}Si_{16}B_6C_1$ | 16 | 0.19 | 0.081 | 1.52 | 35 | 0.1 | 0.6 | 0.3 |
| $Fe_{77}Si_{16}B_6C_1$ | 18 | 0.19 | 0.082 | 1.52 | 35 | 0.1 | 1 | 0.3 |
| $Fe_{77}Si_{16}B_6C_1$ | 20 | 0.19 | 0.082 | 1.53 | 50 | 0.1 | 1 | 0.4 |
| $Fe_{77}Si_{16}B_6C_1$ | 19 | 0.20 | 0.083 | 1.52 | 50 | 0.2 | 0.6 | 0.4 |
| $Fe_{77}Si_{16}B_6C_1$ | 20 | 0.19 | 0.082 | 1.53 | 35 | 0.1 | 0.6 | 0.4 |
| $Fe_{77}Si_{16}B_6C_1$ | 21 | 0.17 | 0.079 | 1.53 | 50 | 0.1 | 0.6 | 0.5 |
| $Fe_{77}Si_{16}B_6C_1$ | 22 | 0.18 | 0.08 | 1.53 | 50 | 0.1 | 1 | 0.5 |
| $Fe_{77}Si_{16}B_6C_1$ | 22 | 0.19 | 0.081 | 1.53 | 50 | 0.2 | 0.6 | 0.5 |
| $Fe_{77}Si_{16}B_6C_1$ | 20 | 0.17 | 0.078 | 1.53 | 35 | 0.1 | 0.6 | 0.5 |
| $Fe_{77}Si_{16}B_6C_1$ | 21 | 0.15 | 0.075 | 1.52 | 50 | 0.1 | 0.6 | 0.6 |
| $Fe_{77}Si_{15}B_7C_1$ | 15 | 0.19 | 0.082 | 1.52 | 50 | 0.1 | 1 | 0.3 |
| $Fe_{77}Si_{15}B_7C_1$ | 15 | 0.21 | 0.085 | 1.51 | 50 | 0.2 | 0.6 | 0.3 |
| $Fe_{77}Si_{15}B_7C_1$ | 16 | 0.19 | 0.081 | 1.52 | 35 | 0.1 | 0.6 | 0.3 |

TABLE 6-continued

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| $Fe_{77}Si_{15}B_7C_1$ | 20 | 0.20 | 0.084 | 1.52 | 35 | 0.1 | 1 | 0.3 |
| $Fe_{77}Si_{15}B_7C_1$ | 19 | 0.19 | 0.081 | 1.53 | 50 | 0.1 | 1 | 0.4 |
| $Fe_{77}Si_{15}B_7C_1$ | 18 | 0.20 | 0.083 | 1.53 | 50 | 0.2 | 0.6 | 0.4 |
| $Fe_{77}Si_{15}B_7C_1$ | 20 | 0.19 | 0.081 | 1.53 | 35 | 0.1 | 0.6 | 0.4 |
| $Fe_{77}Si_{15}B_7C_1$ | 20 | 0.17 | 0.079 | 1.53 | 50 | 0.1 | 0.6 | 0.5 |
| $Fe_{77}Si_{15}B_7C_1$ | 21 | 0.18 | 0.08 | 1.53 | 50 | 0.1 | 1 | 0.5 |
| $Fe_{77}Si_{15}B_7C_1$ | 22 | 0.19 | 0.082 | 1.53 | 50 | 0.2 | 0.6 | 0.5 |
| $Fe_{77}Si_{15}B_7C_1$ | 20 | 0.18 | 0.08 | 1.53 | 35 | 0.1 | 0.6 | 0.5 |
| $Fe_{77}Si_{15}B_7C_1$ | 21 | 0.17 | 0.079 | 1.53 | 50 | 0.1 | 0.6 | 0.6 |

TABLE 7

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| Example of this invention | | | | | | | | |
| $Fe_{78}Si_{14}B_7C_1$ | 15 | 0.20 | 0.084 | 1.53 | 50 | 0.1 | 1 | 0.3 |
| $Fe_{78}Si_{14}B_7C_1$ | 17 | 0.20 | 0.086 | 1.53 | 50 | 0.2 | 0.6 | 0.3 |
| $Fe_{78}Si_{14}B_7C_1$ | 15 | 0.20 | 0.084 | 1.53 | 35 | 0.1 | 0.6 | 0.3 |
| $Fe_{78}Si_{14}B_7C_1$ | 20 | 0.21 | 0.085 | 1.53 | 35 | 0.1 | 1 | 0.3 |
| $Fe_{78}Si_{14}B_7C_1$ | 20 | 0.20 | 0.084 | 1.54 | 50 | 0.1 | 1 | 0.4 |
| $Fe_{78}Si_{14}B_7C_1$ | 19 | 0.22 | 0.087 | 1.53 | 50 | 0.2 | 0.6 | 0.4 |
| $Fe_{78}Si_{14}B_7C_1$ | 18 | 0.20 | 0.083 | 1.54 | 35 | 0.1 | 0.6 | 0.4 |
| $Fe_{78}Si_{14}B_7C_1$ | 20 | 0.20 | 0.083 | 1.54 | 50 | 0.1 | 0.6 | 0.5 |
| $Fe_{78}Si_{14}B_7C_1$ | 22 | 0.19 | 0.082 | 1.54 | 50 | 0.1 | 1 | 0.5 |
| $Fe_{78}Si_{14}B_7C_1$ | 21 | 0.21 | 0.085 | 1.54 | 50 | 0.2 | 0.6 | 0.5 |
| $Fe_{78}Si_{14}B_7C_1$ | 20 | 0.19 | 0.082 | 1.54 | 35 | 0.1 | 0.6 | 0.5 |
| $Fe_{78}Si_{14}B_7C_1$ | 2i | 0.19 | 0.081 | 1.53 | 50 | 0.1 | 0.6 | 0.6 |
| $Fe_{78}Si_{14}B_8$ | 16 | 0.17 | 0.078 | 1.53 | 50 | 0.1 | 1 | 0.3 |
| $Fe_{78}Si_{14}B_8$ | 15 | 0.17 | 0.079 | 1.53 | 50 | 0.2 | 0.6 | 0.3 |
| $Fe_{78}Si_{14}B_8$ | 17 | 0.16 | 0.077 | 1.54 | 35 | 0.1 | 0.6 | 0.3 |
| $Fe_{78}Si_{14}B_8$ | 20 | 0.17 | 0.078 | 1.54 | 35 | 0.1 | 1 | 0.3 |
| $Fe_{78}Si_{14}B_8$ | 18 | 0.17 | 0.078 | 1.54 | 50 | 0.1 | 1 | 0.4 |
| $Fe_{78}Si_{14}B_8$ | 20 | 0.17 | 0.079 | 1.54 | 50 | 0.2 | 0.6 | 0.4 |
| $Fe_{78}Si_{14}B_8$ | 18 | 0.16 | 0.077 | 1.54 | 50 | 0.1 | 0.6 | 0.5 |
| $Fe_{78}Si_{14}B_8$ | 22 | 0.17 | 0.078 | 1.54 | 50 | 0.1 | 1 | 0.5 |
| $Fe_{78}Si_{14}B_8$ | 21 | 0.17 | 0.079 | 1.54 | 50 | 0.2 | 0.6 | 0.5 |
| $Fe_{78}Si_{14}B_8$ | 20 | 0.16 | 0.076 | 1.55 | 35 | 0.1 | 0.6 | 0.5 |
| $Fe_{78}Si_{14}B_8$ | 20 | 0.15 | 0.075 | 1.54 | 50 | 0.1 | 0.6 | 0.6 |
| $Fe_{78}Si_{12}B_{10}$ | 16 | 0.16 | 0.077 | 1.54 | 50 | 0.1 | 1 | 0.3 |
| $Fe_{78}Si_{12}B_{10}$ | 16 | 0.17 | 0.078 | 1.54 | 50 | 0.2 | 0.6 | 0.3 |
| $Fe_{78}Si_{12}B_{10}$ | 15 | 0.16 | 0.077 | 1.54 | 35 | 0.1 | 0.6 | 0.3 |
| $Fe_{78}Si_{12}B_{10}$ | 19 | 0.17 | 0.078 | 1.54 | 35 | 0.1 | 1 | 0.3 |
| $Fe_{78}Si_{12}B_{10}$ | 20 | 0.16 | 0.677 | 1.55 | 50 | 0.1 | 1 | 0.4 |
| $Fe_{78}Si_{12}B_{10}$ | 19 | 0.17 | 0.079 | 1.54 | 50 | 0.2 | 0.6 | 0.4 |
| $Fe_{78}Si_{12}B_{10}$ | 20 | 0.16 | 0.077 | 1.55 | 35 | 0.1 | 0.6 | 0.4 |
| $Fe_{78}Si_{12}B_{10}$ | 18 | 0.16 | 0.076 | 1.55 | 50 | 0.1 | 0.6 | 0.5 |
| $Fe_{78}Si_{12}B_{10}$ | 22 | 0.16 | 0.076 | 1.55 | 50 | 0.1 | 1 | 0.5 |
| $Fe_{78}Si_{12}B_{10}$ | 20 | 0.17 | 0.078 | 1.55 | 50 | 0.2 | 0.6 | 0.5 |
| $Fe_{78}Si_{12}B_{10}$ | 20 | 0.15 | 0.075 | 1.54 | 35 | 0.1 | 0.6 | 0.5 |
| $Fe_{78}Si_{12}B_{10}$ | 21 | 0.14 | 0.074 | 1.55 | 50 | 0.1 | 0.6 | 0.6 |

TABLE 8

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| Example of this invention | | | | | | | | |
| $Fe_{78}Si_{12}B_9C_1$ | 15 | 0.17 | 0.078 | 1.53 | 50 | 0.1 | 1 | 0.3 |
| $Fe_{78}Si_{12}B_9C_1$ | 17 | 0.17 | 0.079 | 1.53 | 50 | 0.2 | 0.6 | 0.3 |

TABLE 8-continued

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| $Fe_{78}Si_{12}B_9C_1$ | 17 | 0.17 | 0.078 | 1.54 | 35 | 0.1 | 0.6 | 0.3 |
| $Fe_{78}Si_{12}B_9C_1$ | 20 | 0.16 | 0.077 | 1.53 | 35 | 0.1 | 1 | 0.3 |
| $Fe_{78}Si_{12}B_9C_1$ | 18 | 0.16 | 0.076 | 1.54 | 50 | 0.1 | 1 | 0.4 |
| $Fe_{78}Si_{12}B_9C_1$ | 19 | 0.17 | 0.078 | 1.54 | 50 | 0.2 | 0.6 | 0.4 |
| $Fe_{78}Si_{12}B_9C_1$ | 20 | 0.16 | 0.076 | 1.54 | 35 | 0.1 | 0.6 | 0.4 |
| $Fe_{78}Si_{12}B_9C_1$ | 21 | 0.15 | 0.075 | 1.55 | 50 | 0.1 | 0.6 | 0.5 |
| $Fe_{78}Si_{12}B_9C_1$ | 22 | 0.16 | 0.076 | 1.55 | 50 | 0.1 | 1 | 0.5 |
| $Fe_{78}Si_{12}B_9C_1$ | 22 | 0.17 | 0.078 | 1.55 | 50 | 0.2 | 0.6 | 0.5 |
| $Fe_{78}Si_{12}B_9C_1$ | 20 | 0.16 | 0.076 | 1.55 | 35 | 0.1 | 0.6 | 0.5 |
| $Fe_{78}Si_{12}B_9C_1$ | 21 | 0.15 | 0.075 | 1.54 | 50 | 0.1 | 0.6 | 0.6 |
| $Fe_{78}Si_{13.5}B_8Mn_{0.5}$ | 16 | 0.19 | 0.082 | 1.52 | 50 | 0.1 | 1 | 0.3 |
| $Fe_{78}Si_{13.5}B_8Mn_{0.5}$ | 16 | 0.20 | 0.083 | 1.53 | 50 | 0.2 | 0.6 | 0.3 |
| $Fe_{78}Si_{13.5}B_8Mn_{0.5}$ | 15 | 0.20 | 0.083 | 1.52 | 35 | 0.1 | 0.6 | 0.3 |
| $Fe_{78}Si_{13.5}B_8Mn_{0.5}$ | 20 | 0.21 | 0.085 | 1.53 | 35 | 0.1 | 1 | 0.3 |
| $Fe_{78}Si_{13.5}B_8Mn_{0.5}$ | 19 | 0.19 | 0.082 | 1.53 | 50 | 0.1 | 1 | 0.4 |
| $Fe_{78}Si_{13.5}B_8Mn_{0.5}$ | 20 | 0.20 | 0.083 | 1.53 | 50 | 0.2 | 0.6 | 0.4 |
| $Fe_{78}Si_{13.5}B_8Mn_{0.5}$ | 18 | 0.19 | 0.081 | 1.54 | 35 | 0.1 | 0.6 | 0.4 |
| $Fe_{78}Si_{13.5}B_8Mn_{0.5}$ | 20 | 0.18 | 0.08 | 1.53 | 50 | 0.1 | 0.6 | 0.5 |
| $Fe_{78}Si_{13.5}B_8Mn_{0.5}$ | 22 | 0.19 | 0.081 | 1.54 | 50 | 0.1 | 1 | 0.5 |
| $Fe_{78}Si_{13.5}B_8Mn_{0.5}$ | 20 | 0.20 | 0.083 | 1.54 | 50 | 0.2 | 0.6 | 0.5 |
| $Fe_{78}Si_{13.5}B_8Mn_{0.5}$ | 20 | 0.19 | 0.081 | 1.54 | 35 | 0.1 | 0.6 | 0.5 |
| $Fe_{78}Si_{13.5}B_8Mn_{0.5}$ | 21 | 0.17 | 0.079 | 1.54 | 50 | 0.1 | 0.6 | 0.6 |
| $Fe_{78}Si_{12.5}B_9Mn_{0.5}$ | 17 | 0.16 | 0.077 | 1.52 | 50 | 0.1 | 1 | 0.3 |
| $Fe_{78}Si_{12.5}B_9Mn_{0.5}$ | 15 | 0.17 | 0.078 | 1.52 | 50 | 0.2 | 0.6 | 0.3 |
| $Fe_{78}Si_{12.5}B_9Mn_{0.5}$ | 16 | 0.15 | 0.075 | 1.52 | 35 | 0.1 | 0.6 | 0.3 |
| $Fe_{78}Si_{12.5}B_9Mn_{0.5}$ | 20 | 0.17 | 0.078 | 1.53 | 35 | 0.1 | 1 | 0.3 |
| $Fe_{78}Si_{12.5}B_9Mn_{0.5}$ | 18 | 0.16 | 0.077 | 1.54 | 50 | 0.1 | 1 | 0.4 |
| $Fe_{78}Si_{12.5}B_9Mn_{0.5}$ | 21 | 0.18 | 0.08 | 1.53 | 50 | 0.2 | 0.6 | 0.4 |
| $Fe_{78}Si_{12.5}B_9Mn_{0.5}$ | 20 | 0.17 | 0.078 | 1.54 | 35 | 0.1 | 0.6 | 0.4 |
| $Fe_{78}Si_{12.5}B_9Mn_{0.5}$ | 20 | 0.16 | 0.077 | 1.54 | 50 | 0.1 | 0.6 | 0.5 |
| $Fe_{78}Si_{12.5}B_9Mn_{0.5}$ | 22 | 0.17 | 0.078 | 1.53 | 50 | 0.1 | 1 | 0.5 |
| $Fe_{78}Si_{12.5}B_9Mn_{0.5}$ | 19 | 0.18 | 0.08 | 1.54 | 50 | 0.2 | 0.6 | 0.5 |
| $Fe_{78}Si_{12.5}B_9Mn_{0.5}$ | 21 | 0.17 | 0.079 | 1.54 | 35 | 0.1 | 0.6 | 0.5 |
| $Fe_{78}Si_{12.5}B_9Mn_{0.5}$ | 21 | 0.16 | 0.077 | 1.54 | 50 | 0.1 | 0.6 | 0.6 |

TABLE 9

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| Example of this invention | | | | | | | | |
| $Fe_{78}Si_{11.5}B_{10}Mn_{0.5}$ | 15 | 0.15 | 0.075 | 1.52 | 50 | 0.1 | 1 | 0.3 |
| $Fe_{78}Si_{11.5}B_{10}Mn_{0.5}$ | 16 | 0.16 | 0.077 | 1.53 | 50 | 0.2 | 0.6 | 0.3 |
| $Fe_{78}Si_{11.5}B_{10}Mn_{0.5}$ | 16 | 0.16 | 0.076 | 1.52 | 35 | 0.1 | 0.6 | 0.3 |
| $Fe_{78}Si_{11.5}B_{10}Mn_{0.5}$ | 20 | 0.16 | 0.077 | 1.53 | 35 | 0.1 | 1 | 0.3 |
| $Fe_{78}Si_{11.5}B_{10}Mn_{0.5}$ | 18 | 0.16 | 0.076 | 1.53 | 50 | 0.1 | 1 | 0.4 |
| $Fe_{78}Si_{11.5}B_{10}Mn_{0.5}$ | 20 | 0.17 | 0.079 | 1.54 | 50 | 0.2 | 0.6 | 0.4 |
| $Fe_{78}Si_{11.5}B_{10}Mn_{0.5}$ | 20 | 0.16 | 0.076 | 1.54 | 35 | 0.1 | 0.6 | 0.4 |
| $Fe_{78}Si_{11.5}B_{10}Mn_{0.5}$ | 19 | 0.15 | 0.075 | 1.54 | 50 | 0.1 | 0.6 | 0.5 |
| $Fe_{78}Si_{11.5}B_{10}Mn_{0.5}$ | 22 | 0.16 | 0.076 | 1.53 | 50 | 0.1 | 1 | 0.5 |
| $Fe_{78}Si_{11.5}B_{10}Mn_{0.5}$ | 21 | 0.16 | 0.077 | 1.54 | 50 | 0.2 | 0.6 | 0.5 |
| $Fe_{78}Si_{11.5}B_{10}Mn_{0.5}$ | 20 | 0.15 | 0.075 | 1.54 | 35 | 0.1 | 0.6 | 0.5 |
| $Fe_{78}Si_{11.5}B_{10}Mn_{0.5}$ | 20 | 0.14 | 0.074 | 1.54 | 50 | 0.1 | 0.6 | 0.6 |
| Comparative Example | | | | | | | | |
| $Fe_{78}Si_{14}B_8$ | 12 | 2.82 | 0.052 | 1.26 | 30 | 0.15 | 1 | 0.05 |
| $Fe_{78}Si_{14}B_8$ | 31 | 1.75 | 0.342 | 1.35 | 20 | 0.15 | 0.5 | 0.1 |
| $Fe_{78}Si_{14}B_8$ | 32 | 1.17 | 0.245 | 1.42 | 20 | 0.15 | 0.5 | 0.2 |
| $Fe_{78}Si_{12}B_{10}$ | 11 | 1.84 | 0.356 | 1.53 | 45 | 0.15 | 0.5 | 0.1 |
| $Fe_{78}Si_{12}B_{10}$ | 31 | 1.63 | 0.321 | 1.54 | 30 | 0.15 | 0.8 | 0.2 |
| $Fe_{78}Si_{12}B_{10}$ | 33 | 1.66 | 0.326 | 1.54 | 20 | 0.15 | 0.5 | 0.2 |
| $Fe_{78}Si_{12}B_9C_1$ | 10 | 2.95 | 0.542 | 1.53 | 30 | 0.15 | 0.5 | 0.05 |
| $Fe_{78}Si_{12}B_9C_1$ | 32 | 1.29 | 0.265 | 1.54 | 20 | 0.15 | 0.5 | 0.2 |
| $Fe_{78}Si_{12}B_9C_1$ | 33 | 1.78 | 0.346 | 1.54 | 20 | 0.15 | 0.5 | 0.2 |
| $Fe_{78}Si_{13.5}B_8Mn_{0.5}$ | 11 | 2.40 | 0.45 | 1.54 | 45 | 0.15 | 0.5 | 0.1 |
| $Fe_{78}Si_{13.5}B_8Mn_{0.5}$ | 34 | 1.43 | 0.289 | 1.53 | 30 | 0.15 | 0.8 | 0.2 |

TABLE 9-continued

| Composition | Plate thickness (μm) | Surface roughness $Ra_{0.25}$ (μm) | Core loss $W_{13/50}$ (W/kg) | Flux density $B_8$ (T) | Roll peripheral speed (m/s) | Gap (mm) | Slit thickness (mm) | Ejection pressure (kgf/cm$^2$) |
|---|---|---|---|---|---|---|---|---|
| $Fe_{78}Si_{13.5}B_8Mn_{0.5}$ | 35 | 1.31 | 0.268 | 1.53 | 20 | 0.15 | 0.5 | 0.2 |
| $Fe_{78}Si_{12.5}B_9Mn_{0.5}$ | 12 | 3.04 | 0.557 | 1.52 | 30 | 0.15 | 0.5 | 0.05 |
| $Fe_{78}Si_{12.5}B_9Mn_{0.5}$ | 31 | 1.56 | 0.31 | 1.53 | 20 | 0.15 | 0.5 | 0.2 |
| $Fe_{78}Si_{12.5}B_9Mn_{0.5}$ | 31 | 1.25 | 0.258 | 1.54 | 20 | 0.15 | 0.5 | 0.2 |
| $Fe_{78}Si_{11.5}B_{10}Mn_{0.5}$ | 13 | 2.54 | 0.474 | 1.53 | 45 | 0.15 | 0.5 | 0.1 |
| $Fe_{78}Si_{11.5}B_{10}Mn_{0.5}$ | 33 | 1.87 | 0.361 | 1.54 | 30 | 0.15 | 0.8 | 0.2 |
| $Fe_{78}Si_{11.5}B_{10}Mn_{0.5}$ | 30 | 1.81 | 0.352 | 1.52 | 20 | 0.15 | 0.5 | 0.2 |

What is claimed is:

1. An Fe—Si—B base amorphous alloy plate having a boron content of about 6 to 10 at %, wherein the thickness of said plate is about 21 to 25 μm, and the surface roughness $Ra_{0.25}$ of said plate is 0.21 to 0.3 μm, said surface roughness being the center line average roughness on a contact face of said plate with a quenching roll, which is determined at a cut-off value of 0.25 mm.

2. The alloy defined in claim 1, made by a casting process from the molten metal on the surface of a roll, wherein the ejection pressure of said molten metal on said roll is about 0.3 to 0.6 kg/cm$^2$, and the roll peripheral speed is about 35 to 50 m/sec in producing by a single-roll quick cooling solidification method.

3. A solid alloy plate consisting essentially of Fe, Si and about 6–10 at % boron and having a core loss $W_{13/50}$ in W/kg within the following equation $$W=a+b\cdot t+c\cdot Ra_{0.8}$$

wherein t designates plate thickness in μm and $Ra_{0.8}$ designates plate center line average roughness on a contact face with a quenching roll, determined at a cut-off value of 0.8 mm, and wherein a is in the range of 0–0.2, b is in the range of 0.001–0.004 and c is a constant in the range of 0.05–0.2, said plate having a thickness of about 21 to 25 μm and a surface roughness $Ra_{0.25}$ of 0.21 to 0.3 μm, said surface roughness being the center line average roughness on a contact face of said plate with a quenching roll, which is determined at a cut-off value of 0.25 mm.

4. An Fe—Si—B base amorphous alloy cast in the form of a plate having a boron content of about 6 to 10 at %, wherein the surface roughness $Ra_{0.25}$ of said plate is 0.21 to 0.3 μm, said surface roughness being the centerline average roughness on a contact face of said plate with a quenching roll, which is determined at a cut-off value of 0.25 mm.

5. The alloy defined in claim 1, further having iron loss $W_{13/50}$ of 0.02 W/Kg or less.

* * * * *

UNITED STATES PATENT AND TRADEMARK OFFICE

CERTIFICATE OF CORRECTION

PATENT NO. : 6,273,967 B1
DATED : August 14, 2001
INVENTOR(S) : Matsuki et al.

It is certified that error appears in the above-identified patent and that said Letters Patent is hereby corrected as shown below:

Column 8,
Line 24, please change "kgf/cm2" to -- $kgfcm^2$ --.

Column 13,
At table 4, in row 16, at the subheading "Core loss", please change "0.685" to -- 0.085 --; and at table 5, in row 4, at the subheading "Slit thickness", please change "0.6" to -- 1 --.

Column 17,
At table 7, at row 12, at the subheading "Plate thickness", please change "2i" to -- 21 --; and at row 28, at the subheading "Core loss", please change "0.677" to -- 0.077 --.

Signed and Sealed this

Sixteenth Day of April, 2002

*Attest:*

*Attesting Officer*

JAMES E. ROGAN
*Director of the United States Patent and Trademark Office*